US010882732B2

(12) United States Patent
Haile et al.

(10) Patent No.: US 10,882,732 B2
(45) Date of Patent: Jan. 5, 2021

(54) SYSTEM AND METHOD FOR AUTOMATIC FUELING OF HYDRAULIC FRACTURING AND OTHER OILFIELD EQUIPMENT

(71) Applicants: Luke Haile, Fort Worth, TX (US); Daniel Thomas Haile, Archer City, TX (US)

(72) Inventors: Luke Haile, Fort Worth, TX (US); Daniel Thomas Haile, Archer City, TX (US)

(73) Assignee: American Energy Innovations, LLC, Springtown, TX (US)

( * ) Notice: Subject to any disclaimer, the term of this patent is extended or adjusted under 35 U.S.C. 154(b) by 61 days.

(21) Appl. No.: 16/094,810

(22) PCT Filed: Apr. 24, 2017

(86) PCT No.: PCT/US2017/029173

§ 371 (c)(1),
(2) Date: Oct. 18, 2018

(87) PCT Pub. No.: WO2017/185094

PCT Pub. Date: Oct. 26, 2017

(65) Prior Publication Data

US 2019/0119096 A1 Apr. 25, 2019

Related U.S. Application Data

(63) Continuation-in-part of application No. 15/135,761, filed on Apr. 22, 2016, now Pat. No. 10,759,649.

(51) Int. Cl.
*B67D 7/04* (2010.01)
*B67D 7/14* (2010.01)
(Continued)

(52) U.S. Cl.
CPC ..... *B67D 7/0401* (2013.01); *B67D 7/145* (2013.01); *B67D 7/16* (2013.01); *B67D 7/303* (2013.01);
(Continued)

(58) Field of Classification Search
CPC ..... B67D 7/04; B67D 7/0401; B67D 7/145; B67D 7/16; B67D 7/3209; B67D 7/40;
(Continued)

(56) References Cited

U.S. PATENT DOCUMENTS 2,176,635 A 10/1938 Mattson
2,516,150 A 7/1950 Samiran
(Continued)

FOREIGN PATENT DOCUMENTS

CA 2693567 C 10/2010
CA 2789386 A1 8/2011
(Continued)

OTHER PUBLICATIONS

International Search Report and Written Opinion of the International Searching Authority dated Jun. 14, 2018 from counterpart International Application No. PCT/US2017/29173.
(Continued)

*Primary Examiner* — Timothy L Maust
*Assistant Examiner* — James R Hakomaki
(74) *Attorney, Agent, or Firm* — James E. Walton

(57) ABSTRACT

A system and method for fueling multiple saddle tanks of hydraulic fracturing equipment from a single self-propelled cart. The cart having multiple retractable fuel lines for providing and obtaining fuel. Each retractable fuel supply line uses a flowmeter, a ball valve, and an electrically actuated valve to provide remote control to a controller based on a user's selected fueling requirements. An electronic reporting system provides fuel data to operators and
(Continued)

users. Fuel data such as fuel tank status, an amount of fuel usage over a stage level, a daily level, or job level along with a fill level of the fuel tank.

22 Claims, 20 Drawing Sheets

(51) Int. Cl.

| | |
|---|---|
| ***B67D 7/16*** | (2010.01) |
| ***B67D 7/84*** | (2010.01) |
| ***B67D 7/32*** | (2010.01) |
| ***B67D 7/30*** | (2010.01) |
| ***E21B 43/26*** | (2006.01) |
| ***B67D 7/78*** | (2010.01) |
| ***B67D 7/36*** | (2010.01) |
| ***B67D 7/40*** | (2010.01) |

(52) U.S. Cl.
CPC ..... *B67D 7/3209* (2013.01); *B67D 7/845* (2013.01); *B67D 7/36* (2013.01); *B67D 7/40* (2013.01); *B67D 7/78* (2013.01); *B67D 2210/00139* (2013.01); *E21B 43/26* (2013.01)

(58) Field of Classification Search
CPC ..... B67D 7/78; B67D 7/845; B67D 7/125; B67D 7/303; B67D 7/36; B67D 2201/00139; B67S 7/845; E21B 43/26
USPC ..... 141/230, 231
See application file for complete search history.

(56) References Cited

U.S. PATENT DOCUMENTS

| | | | | |
|---|---|---|---|---|
| 2,769,572 | A | 11/1956 | Harman et al. | |
| 3,028,010 | A | 4/1962 | Headrick | |
| 3,111,968 | A | 11/1963 | Headrick | |
| 3,136,295 | A | 6/1964 | Gramo | |
| 3,422,917 | A | 1/1969 | Guinot | |
| 3,547,141 | A | 12/1970 | Alexander et al. | |
| 3,618,643 | A | 11/1971 | Thomson et al. | |
| 3,648,720 | A | 3/1972 | Kornahrens | |
| 4,059,134 | A | 11/1977 | Violette | |
| 4,063,609 | A | 12/1977 | Kincaid | |
| 4,139,019 | A | 2/1979 | Bresie et al. | |
| 4,244,522 | A | 1/1981 | Hartwig | |
| 4,249,633 | A | 2/1981 | Dunbar | |
| 4,591,115 | A | 5/1986 | DeCarlo | |
| 4,638,842 | A | 1/1987 | Hawley et al. | |
| 4,671,329 | A | 6/1987 | Kovacevich, Jr. | |
| 4,770,317 | A | 9/1988 | Podgers et al. | |
| 4,886,282 | A | 12/1989 | Wilkinson et al. | |
| 5,025,827 | A | 6/1991 | Weng | |
| 5,027,871 | A | 7/1991 | Guenther | |
| 5,295,521 | A | 3/1994 | Bedi | |
| 5,388,622 | A | 2/1995 | Phillips | |
| 5,406,988 | A | 4/1995 | Hopkins | |
| 5,417,239 | A | 5/1995 | Ford | |
| 5,454,408 | A | 10/1995 | DiBella et al. | |
| 5,503,199 | A | 4/1996 | Whitley, II et al. | |
| 5,538,051 | A | 7/1996 | Brown et al. | |
| 5,609,191 | A | 3/1997 | Topping et al. | |
| 5,651,400 | A | 7/1997 | Corts et al. | |
| 5,708,424 | A | 1/1998 | Orlando et al. | |
| 5,769,109 | A | 6/1998 | Stanton et al. | |
| 5,884,675 | A | 3/1999 | Krasnov | |
| 5,918,256 | A | 6/1999 | Delaney | |
| 5,944,074 | A | 8/1999 | Leahy et al. | |
| 5,975,162 | A | 11/1999 | Link, Jr. | |
| D427,021 | S | 6/2000 | Moran | |
| 6,152,197 | A | 11/2000 | Gerardot | |
| 6,178,990 | B1 | 1/2001 | Bellenger et al. | |
| 6,206,056 | B1 | 3/2001 | Lagache | |
| 6,213,515 | B1 | 4/2001 | La Terra | |
| 6,282,953 | B1 | 9/2001 | Benjey | |
| 6,382,225 | B1 | 5/2002 | Tipton | |
| 6,390,151 | B1 * | 5/2002 | Christman | G06Q 50/06 141/231 |
| 6,420,961 | B1 * | 7/2002 | Bates | B67D 7/145 340/10.1 |
| 6,450,217 | B2 | 9/2002 | Mutter | |
| 6,478,576 | B1 | 11/2002 | Bradt et al. | |
| 6,564,615 | B1 | 5/2003 | Carter | |
| 6,637,466 | B2 | 10/2003 | Mills, Jr. | |
| 6,648,086 | B1 | 11/2003 | Schulte | |
| 6,651,706 | B2 | 11/2003 | Litt | |
| 6,697,705 | B2 | 2/2004 | Johnson et al. | |
| 6,755,225 | B1 | 6/2004 | Niedwiecki et al. | |
| 6,761,194 | B1 | 7/2004 | Blong | |
| 6,786,245 | B1 | 9/2004 | Eichelberger et al. | |
| 6,792,966 | B2 | 9/2004 | Harvey | |
| 6,907,371 | B2 | 6/2005 | Klinger et al. | |
| 6,945,288 | B1 | 9/2005 | Brakefield et al. | |
| 7,020,906 | B2 | 4/2006 | Cuffari, Jr. et al. | |
| 7,063,276 | B2 | 6/2006 | Newton | |
| 7,106,026 | B2 | 9/2006 | Moore | |
| D547,021 | S | 7/2007 | Stein | |
| 7,308,918 | B1 | 12/2007 | Brakefield | |
| 7,328,728 | B1 * | 2/2008 | Vilar | B60P 3/14 137/565.17 |
| 7,353,808 | B2 | 4/2008 | Kakoo | |
| 7,415,995 | B2 | 8/2008 | Plummer et al. | |
| 7,441,569 | B2 | 10/2008 | Lease | |
| 7,458,543 | B2 | 12/2008 | Cutler et al. | |
| 7,568,507 | B2 | 8/2009 | Farese et al. | |
| 7,602,143 | B2 | 10/2009 | Capizzo | |
| 7,628,182 | B2 | 12/2009 | Poulter et al. | |
| 7,762,363 | B1 | 7/2010 | Hirschfeld | |
| 7,938,151 | B2 | 5/2011 | Hockner | |
| 8,109,300 | B2 | 2/2012 | Brakefield et al. | |
| 8,245,889 | B1 | 8/2012 | Starns | |
| 8,327,963 | B1 | 12/2012 | Faulkingham | |
| 8,393,360 | B2 | 3/2013 | Brakefield et al. | |
| 8,459,585 | B1 | 6/2013 | Elder | |
| 8,671,998 | B2 | 3/2014 | Lohmann | |
| 8,731,725 | B2 | 5/2014 | Trottier et al. | |
| 9,305,406 | B2 * | 4/2016 | Divelbiss | G05B 15/02 |
| 9,346,662 | B2 | 5/2016 | Van Vliet et al. | |
| 9,371,831 | B2 | 6/2016 | Moffitt, Jr. | |
| 9,463,970 | B2 * | 10/2016 | Orcutt | B67D 7/02 |
| 9,586,805 | B1 | 3/2017 | Shock | |
| 9,939,305 | B2 | 4/2018 | Tetil | |
| 2003/0098017 | A1 | 5/2003 | Williams, Sr. | |
| 2003/0111129 | A1 | 6/2003 | Mill, Jr. | |
| 2003/0210152 | A1 | 11/2003 | Cothern et al. | |
| 2004/0045623 | A1 * | 3/2004 | Parker, III | G06Q 10/08 141/1 |
| 2004/0187950 | A1 | 9/2004 | Cohen et al. | |
| 2005/0199312 | A1 | 9/2005 | Wiens | |
| 2006/0086411 | A1 | 4/2006 | Luca | |
| 2006/0118201 | A1 | 6/2006 | Li et al. | |
| 2006/0196541 | A1 | 9/2006 | Gerken et al. | |
| 2006/0266430 | A1 | 11/2006 | Luca | |
| 2007/0079891 | A1 | 4/2007 | Farese et al. | |
| 2007/0164031 | A1 | 7/2007 | Holz | |
| 2007/0181212 | A1 | 8/2007 | Fell | |
| 2007/0189906 | A1 | 8/2007 | Palvolgyi | |
| 2008/0165001 | A1 | 7/2008 | Drake et al. | |
| 2008/0223660 | A1 | 9/2008 | Williams et al. | |
| 2008/0277018 | A1 | 11/2008 | Worswick et al. | |
| 2009/0277018 | A1 | 11/2009 | Arena | |
| 2010/0089486 | A1 | 4/2010 | Koeninger et al. | |
| 2010/0108179 | A1 | 5/2010 | Emerson, Jr. | |
| 2011/0048572 | A1 | 3/2011 | Batson et al. | |
| 2011/0197988 | A1 | 8/2011 | Van Vliet et al. | |
| 2011/0297271 | A1 | 12/2011 | Haak | |
| 2012/0221152 | A1 * | 8/2012 | Portocalis | G01F 15/02 700/283 |
| 2013/0015199 | A1 | 1/2013 | Tavolazzi | |
| 2013/0092851 | A1 | 4/2013 | Sakiya | |
| 2013/0112313 | A1 | 5/2013 | Donnelly et al. | |
| 2014/0174599 | A1 | 6/2014 | Porcile et al. | |
| 2014/0223992 | A1 | 8/2014 | Harper | |

(56) References Cited

U.S. PATENT DOCUMENTS

| | | | | |
|---|---|---|---|---|
| 2014/0266650 | A1 | 9/2014 | Newhouse | |
| 2015/0013838 | A1* | 1/2015 | Polzin | B67D 7/145 141/94 |
| 2015/0261227 | A1 | 9/2015 | Wiersma | |
| 2015/0285669 | A1 | 10/2015 | Manabe | |
| 2015/0352947 | A1 | 12/2015 | Hubschman et al. | |
| 2016/0244314 | A1 | 8/2016 | Van Vliet et al. | |
| 2016/0362195 | A1 | 12/2016 | Wilkinson et al. | |
| 2017/0221116 | A1* | 8/2017 | Makke | B67D 7/04 |

FOREIGN PATENT DOCUMENTS

| | | | |
|---|---|---|---|
| DE | 4226326 | A1 | 2/1994 |
| WO | 01/77006 | A1 | 10/2001 |
| WO | 2006/005686 | A1 | 1/2006 |
| WO | 2008/083830 | A2 | 7/2008 |
| WO | 2009/026607 | A1 | 3/2009 |

OTHER PUBLICATIONS www.fracshack.com; "Welcome to Frac ShackTM," "Technology" and "Marketing Materials" pages, 9 pages.

www.afdpetroleum.com; "Onsite Refueling" page, 5 pages.

International Search Report and Written Opinion of the International Searching Authority dated Sep. 29, 2017 from counterpart International Application No. PCT/US2017/29173.

International Preliminary Report on Patentability dated Nov. 1, 2018 from counterpart International Application No. PCT/US2017/29173.

Notice of Publication dated Oct. 26, 2017 from counterpart U.S. Appl. No. 15/135,761.

Office Action dated Sep. 22, 2017 from counterpart U.S. Appl. No. 15/135,761.

Advisory Action dated Feb. 11, 2019 from counterpart U.S. Appl. No. 15/135,761.

Amendment dated Aug. 13, 2018 from counterpart U.S. Appl. No. 15/135,761.

Amendment After Final dated Jan. 29, 2019.

Final Office Action dated Nov. 29, 2018 from counterpart U.S. Appl. No. 15/135,761.

Office Action dated May 28, 2018 from counterpart U.S. Appl. No. 15/135,761.

Amendment dated Dec. 22, 2018 from counterpart U.S. Appl. No. 15/135,761.

* cited by examiner

SYSTEM AND METHOD FOR AUTOMATIC FUELING OF HYDRAULIC FRACTURING AND OTHER OILFIELD EQUIPMENT

TECHNICAL FIELD

The present invention relates generally to fueling systems for hydraulic fracturing equipment, and more specifically to a system and method for automatically fueling equipment and reporting important information in a real time for fracing hydrocarbon wells.

DESCRIPTION OF THE PRIOR ART

The fracturing of hydrocarbon wells requires great amounts of pressure. Diesel, natural gas, and or a combination of those driven pumps are utilized in order to generate pressures sufficient to fracture shale deposits. This equipment is located remotely and require refueling several times during a frac job. Conventional systems for fueling hydraulic fracturing equipment use trucks and pump fuel into saddle tanks from the trucks as required to keep the saddle tanks full. Alternative conventional systems bypass the saddle tanks of the hydraulic fracturing equipment and provide a pressurized fuel line and a return line for each piece of equipment. Conventionally data is monitored on a per site basis typically relayed from the single sale pump to a user, therefore no one knows how much fuel each piece of equipment is using in relation to the rest of the fleet. Conventional systems and methods for fueling hydraulic fracturing equipment have disadvantages. First, stopping the frac to refill saddle tanks cost time and money. Second, different frac pump engines require different fuel pressures to operate, and keeping over a dozen pieces of equipment operating at different pressures is difficult. Third, the space at a fracturing site is limited and conventional systems require multiple hoses snaked in and around the pumps and various trailers. Thus, there exists significant room for improvement in the art for overcoming these and other shortcomings of conventional systems and methods for automatically fueling hydraulic fracturing equipment.

BRIEF DESCRIPTION OF THE DRAWINGS

The novel features believed characteristic of the system of the present application are set forth in the appended claims. However, the system itself, as well as a preferred mode of use, and further objectives and advantages thereof, will best be understood by reference to the following detailed description when read in conjunction with the accompanying drawings, in which the leftmost significant digit(s) in the reference numerals denote(s) the first figure in which the respective reference numerals appear, wherein:

Figure 1:
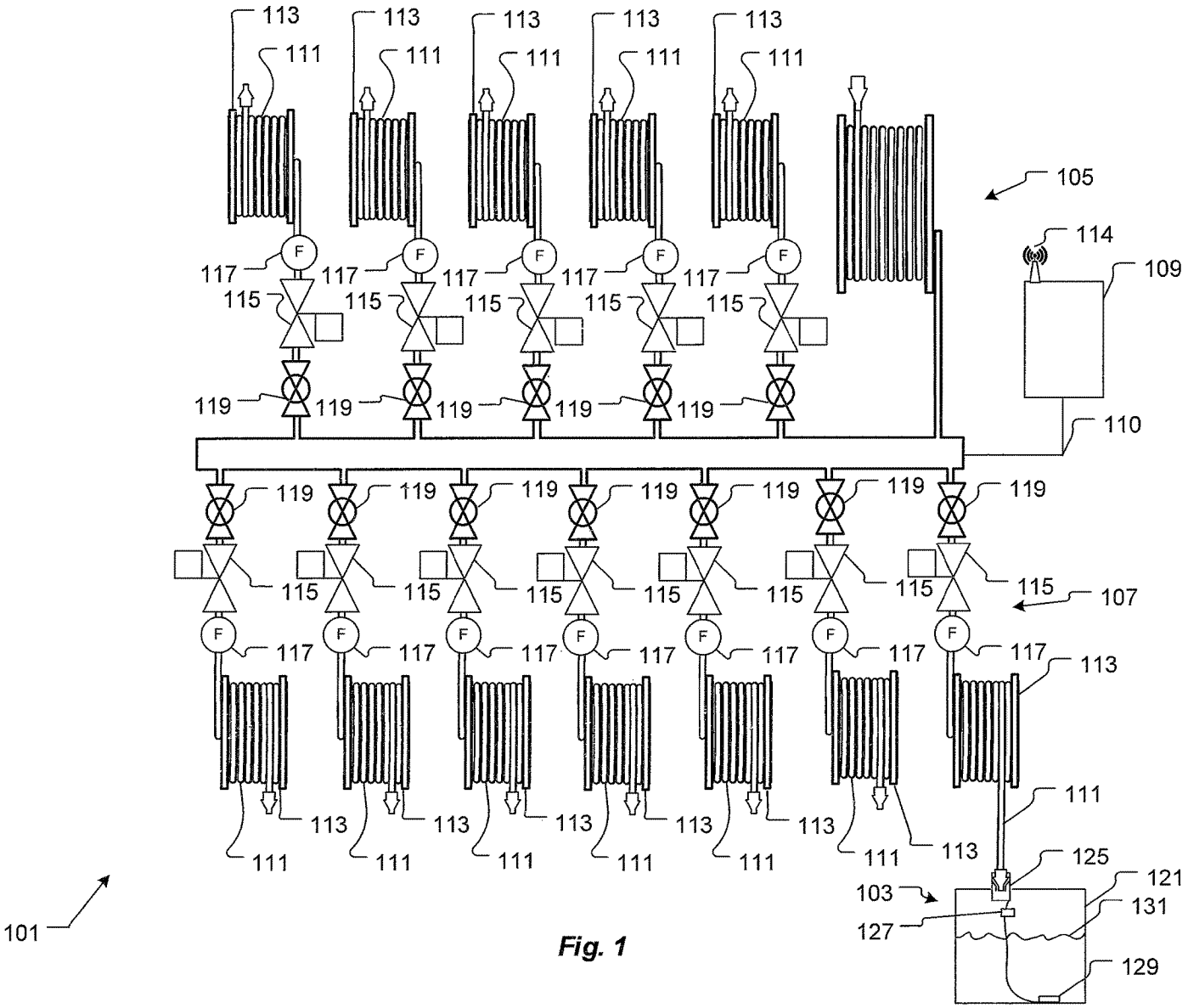
FIG. 1 is a diagram of a system for automatically fueling hydraulic fracturing equipment with the ability to report fuel tank status, usage, and fill level according to the present application.
Figure 2:
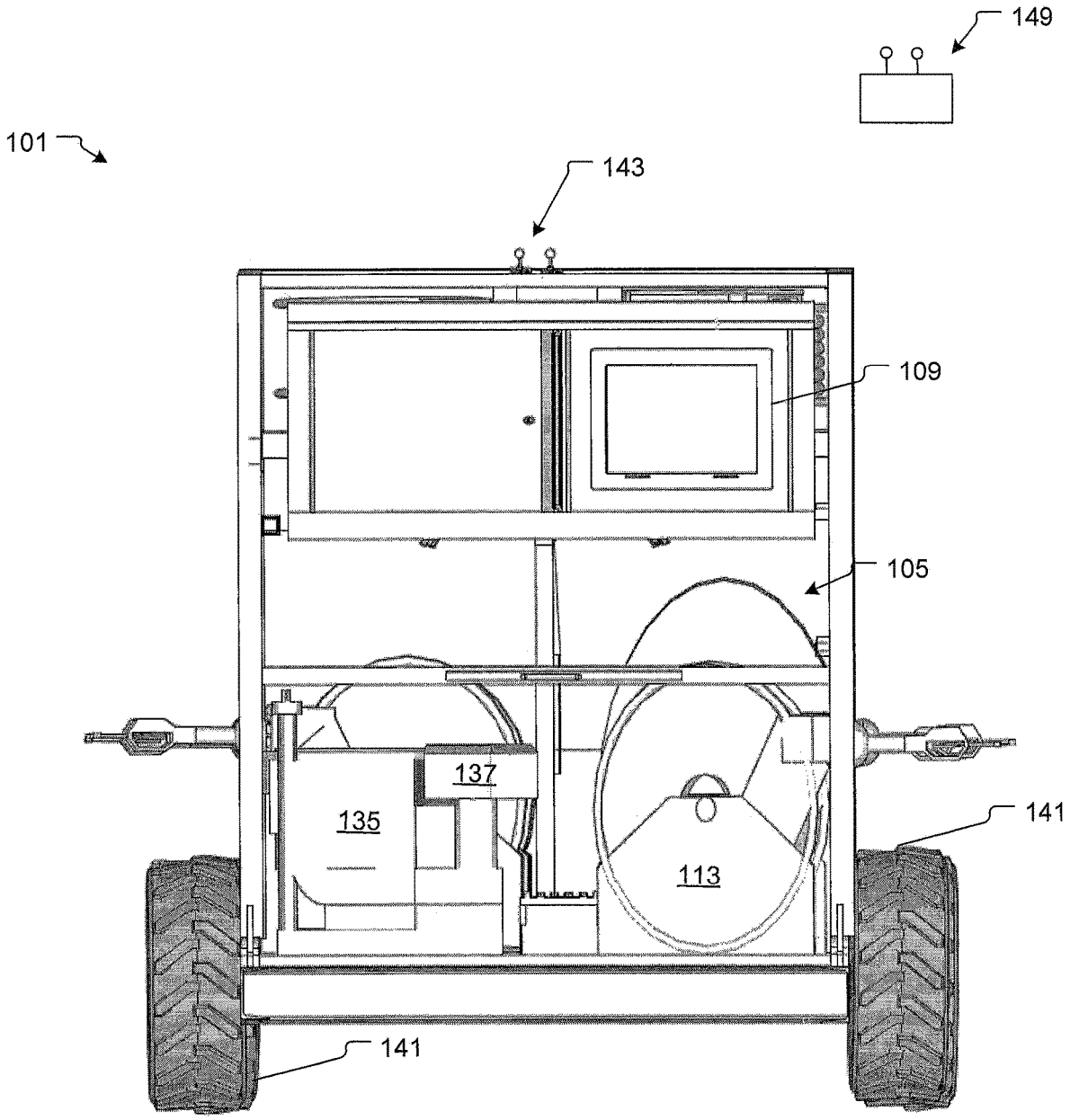
FIG. 2 is an end view of a system for automatically fueling hydraulic fracturing equipment with the ability to report fuel tank status, usage, and fill level according to the present application.
Figure 3:
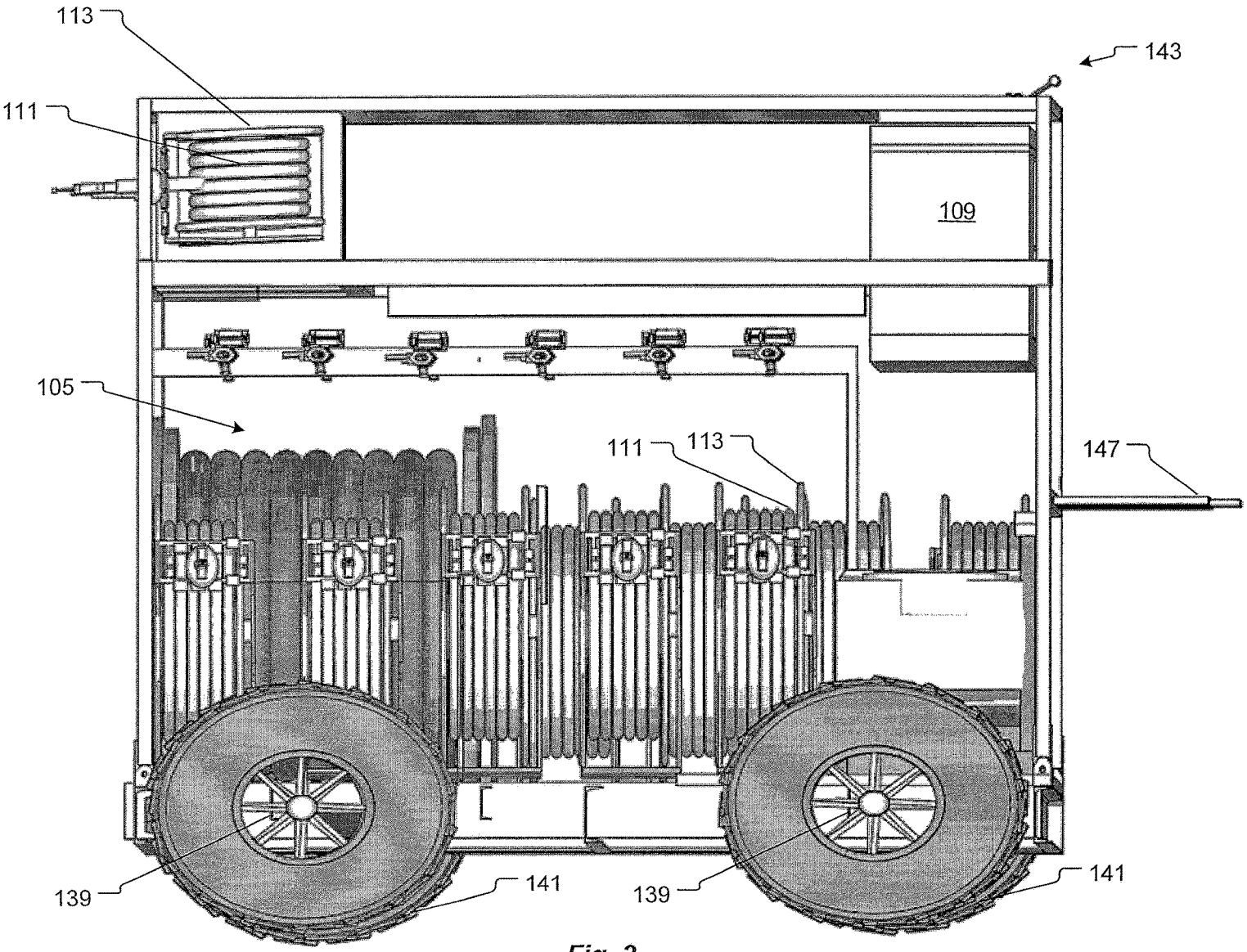
FIG. 3 is a side view of a system for automatically fueling hydraulic fracturing equipment with the ability to report fuel tank status, usage, and fill level according to the present application.
Figure 4:
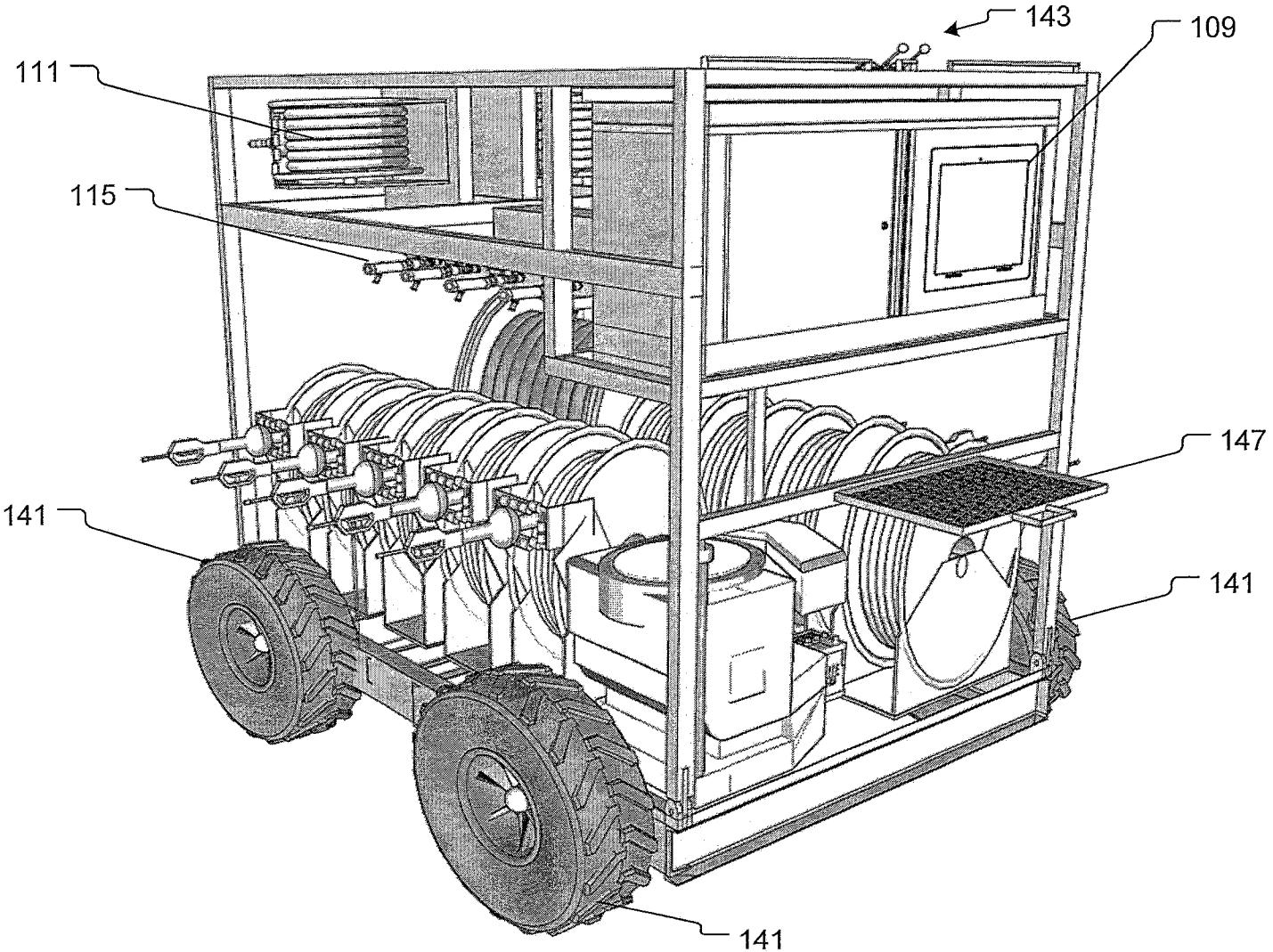
FIG. 4 is a generally downward perspective view of a system for automatically fueling hydraulic fracturing equipment with the ability to report fuel tank status, usage, and fill level according to the present application.
Figure 5:
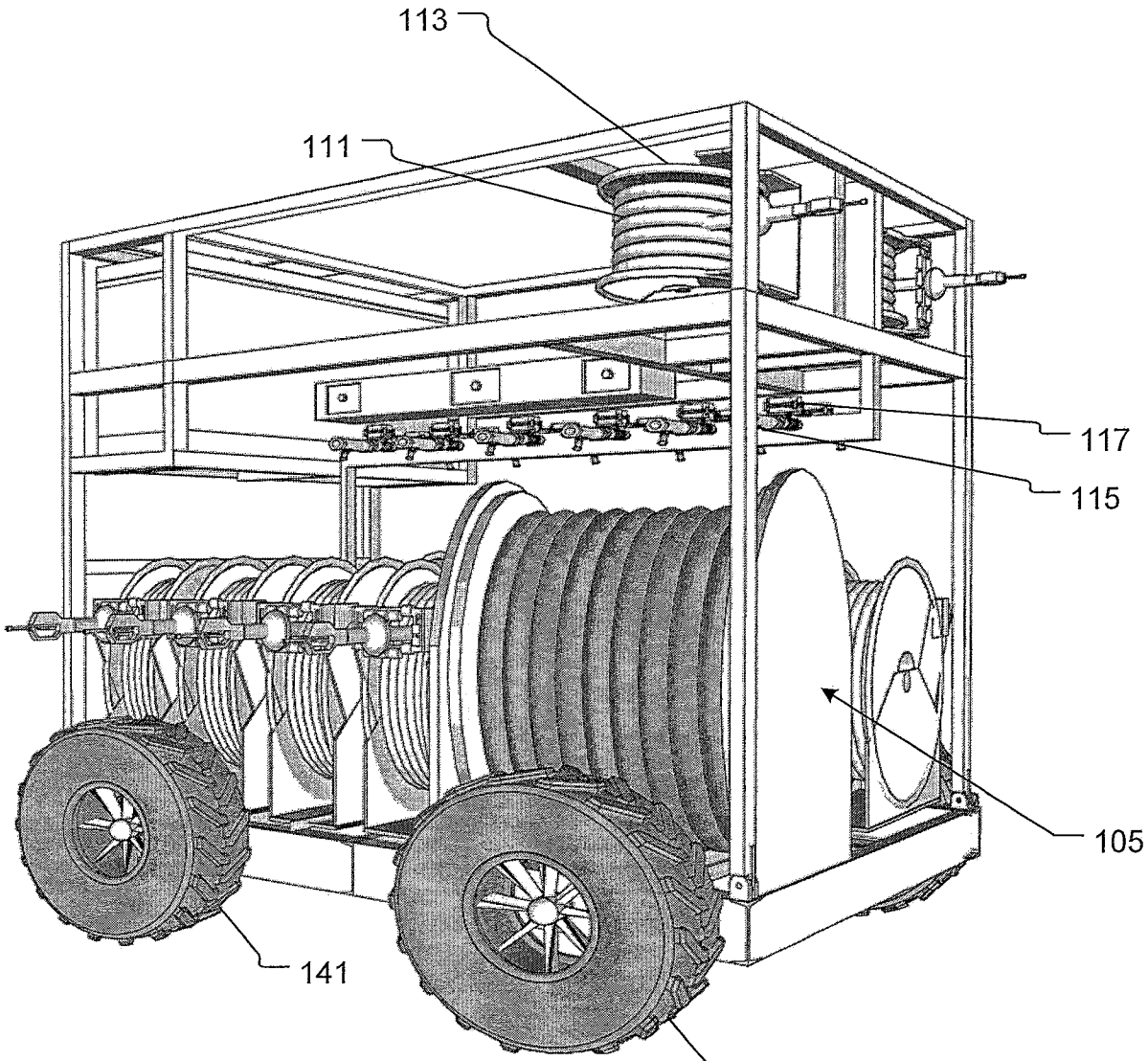
FIG. 5 is a generally upward perspective view of a system for automatically fueling hydraulic fracturing equipment with the ability to report fuel tank status, usage, and fill level according to the present application.

While the system of the present application is susceptible to various modifications and alternative forms, specific embodiments thereof have been shown by way of example in the drawings and are herein described in detail. It should be understood, however, that the description herein of specific embodiments is not intended to limit the method to the particular forms disclosed, but on the contrary, the intention is to cover all modifications, equivalents, and alternatives falling within the spirit and scope of the application as defined by the appended claims.

DESCRIPTION OF THE PREFERRED EMBODIMENT

Illustrative embodiments of the system and method for automatic fueling of hydraulic fracturing equipment with the ability to report fuel tank status, usage, and fill level are provided below. It will, of course, be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Automatic fueling of frac pumps and frac equipment provides fuel to saddle tanks of hydraulic fracturing equipment as needed by the saddle tanks. The system for automatically fueling hydraulic fracturing equipment is comprised of a fuel input system, a fuel output system, and a control system for regulating the flow of fuel from the input system to the output system. Preferably the system is compact to reduce the footprint at fracturing sites. This system comes with the ability to report fuel tank status, usage, and fill level to users at the fracturing site and remote to the fracturing site, for example at the headquarters of the exploration company. Furthermore, the system provides self-propelled carts for distribution of fuel at a drilling site.

Referring now to FIGS. 1-5 in the drawings, a preferred embodiment of mobile fueling platform for automatically providing fuel to a saddle tank of the frac equipment according to the present application is illustrated. System 101 is comprised of a fuel cap system 103, a fuel input system 105, a plurality of fuel output systems 107, and a control system 109. Fuel input system 105 is preferably comprised of an input fuel hose located on a hydraulically driven reel and is retractable. As the user pulls the hose from the reel a spring is biased to provide the force to retract the input hose when needed. Alternatively, fuel input system 105 is comprised of a manifold on the platform wherein a fuel line is coupled to the manifold. Fuel input system is ultimately connected to a supply of fuel located in a tank located on the drill site. Typically the supply of fuel stored in a tank is on a bobtail, a transport, or a fuel shuttle as required for the specific drill site. Fuel flows from the supply of fuel through the cart and into the saddle tank.

Fuel output system 107 is comprised of fuel hose 111, a reel 113, a remote actuated valve 115, a flow meter 117, and a ball valve 119. Reel 113 is retractable like a reel from the input fuel system but is manually driven and is configured to contain the fuel hose when the system does not require a long fuel hose and for when the system is unused. Adjacent the fuel hose 111 is electrical wiring connecting the control system 109 to the fuel cap system 103 located on the saddle tank 121. To facilitate the clarity of the illustrations the hoses between the reels 113 and the remote actuated valves 115 has been removed, however, it should be apparent that the valves 115 are coupled to the reels 113. The preferred embodiment of the reel 113 is a manual reel however due to the weight of some fuel lines a hydraulically driven reel is contemplated by this application. Flow meter 117 is configured to allow the system to report the fill status of the corresponding tank and the fuel tank usage over a stage level, a daily level, and a job level.

While the preferred embodiment utilizes electric valves wired directly to the controller, pneumatic valves controlled by air are contemplated by this application. Tubing would be utilized in place of wiring to air powered valves to open and close the supply of fuel to the pieces of equipment. This aspect increases the safety of the system by removing the proximity of fuel and electricity.

Fuel cap system 103 is comprised of a fuel cap with a male fluid coupling, a high sensor 127, and a low sensor 129. Male fluid coupling is configured to quickly allow the fuel hose 111 connect to the fuel cap system. Each saddle tank will utilize the fuel cap system 103. The high sensor 127 of the fuel cap system is configured to measure the amount of fuel in the saddle tank near the rated capacity of the tank. The low sensor 129 of the fuel cap system is configured to measure the entire amount of fuel in the saddle tank. The high sensor is preferably an ultrasonic sensor and alerts the system once the fluid level in the tank is high enough to break an ultrasonic beam. The low sensor is preferably a pressure sensor and is submerged into the fluid. As the tank is filled the pressure increases. The high sensor is a redundant sensor to ensure that the valve is closed when the fuel level in the tank approaches the tank's capacity. Low sensor 129 provides data to the system in order for the tank fill level to be reported. Alternatively, the fuel cap system further comprises an electric valve controlled by the control system 109 to stop the flow of fuel at the closest connection to the piece of equipment being filled. The additional electric valve also provides redundancy to the valve adjacent the reel.

System 101 further comprises a propulsion system having a combustion motor 135, a hydraulic system 137, a plurality of hydraulic motors 139 coupled to the wheels 141 of the system, and a steering system 143. Steering system 143 is preferably a set of hydraulic valves connecting the hydraulic system 137 to the plurality of hydraulic motors 139. A user stands on foldable bracket 147 and can steer and move the system by moving the steering system. Foldable bracket 147 is configured that the user is able to see over a top of the system to drive it. The propulsion system is preferably both 2 wheel drive and four wheel drive capable by toggling a valve. Since wells sites are typically muddy having a four-wheel drive capable system facilitates moving the cart/platform near the hydraulic fracturing equipment. Furthermore, the unit can be moved by a remote control that operates the hydraulic valves in control of the hydraulic motors 139. With the remote control, the user can drive the unit around the job site and steer clear of obstacles in the confined spaces around a fracturing site.

Control system 109 is preferably a programmable logic controller with a display and assesses the amount of fuel to dispense based upon the low sensor 129. Control system 109 can be calibrated by entering in the distance from a bottom of the saddle tank to the max fill line to determine the relative expected pressures when the tank is near the max fill line. Alternatively, in addition to the low sensor, an ultrasonic distance sensor measures the amount of fuel in the saddle tank by ultrasonically measuring a distance between the ultrasonic distance sensor and the upper surface of the volume of fuel in the saddle tank. High sensor acts as a redundant stop where the valve 115 is closed whenever the top of the fuel is close to the high sensor. High sensor prevents fuel spills when the low sensor fails. Control system 109 is electrically coupled to the high sensor and the low sensor by wiring located adjacent the hose 111. Both the hose 111 and the wiring to the high and low sensor are contained in a common conduit. In the preferred embodiment, the reel 113 is continually coupled between the valve and the hose 111 while the electrical wiring has a disconnect. Alternatively, both the fuel line and the wiring to the high and low sensors have sliprings in the reel and are continually coupled. Control system 109 is also wired to flow meter 117. Control system 109 tracks fuel flow to each tank by the amount of fuel flowing through the flow meter 117 associated with each piece of equipment. This flow data provides users with feedback regarding how efficient the hydraulic fracturing equipment are operating. Furthermore, the control system provides manual control of the valve 115 by a series of switches for each reel. This allows a user to either prevent the remote activation, engage the remote valve, or allow the system to control the valve. Control system may further comprise an indicator tower and emergency stops located on the cart. While the preferred embodiment of the system uses wiring to connect the control system 109 to the sensors and valves, alternatively the control system is wirelessly connected to the sensors of the fuel cap system. Additionally, the controller is wired to electric valves located near the supply of fuel such as on the bobtail, the fuel shuttle, and or the transport. These electric valves are wired to stop the flow of fuel in an emergency by activation of an emergency stop located on the cart. Furthermore, the controller can close the electric valve on the supply of fuel as a redundant fuel stop in addition to the electric valves associated with each reel.

Typically the system 101 is comprised of twelve fuel output systems 107 connected to a single fuel input system 105. This configuration allows for a single platform to fuel a dozen saddle tanks concurrently. Typically the fuel line of the fuel output system is ½" or ¾" diameter and the diameter of the fuel input system is 1¼" to 2" diameter. In the preferred embodiment the control system is powered remotely, alternatively, the system further comprises a generator or solar system to supply voltage to the control system.

Figure 6:
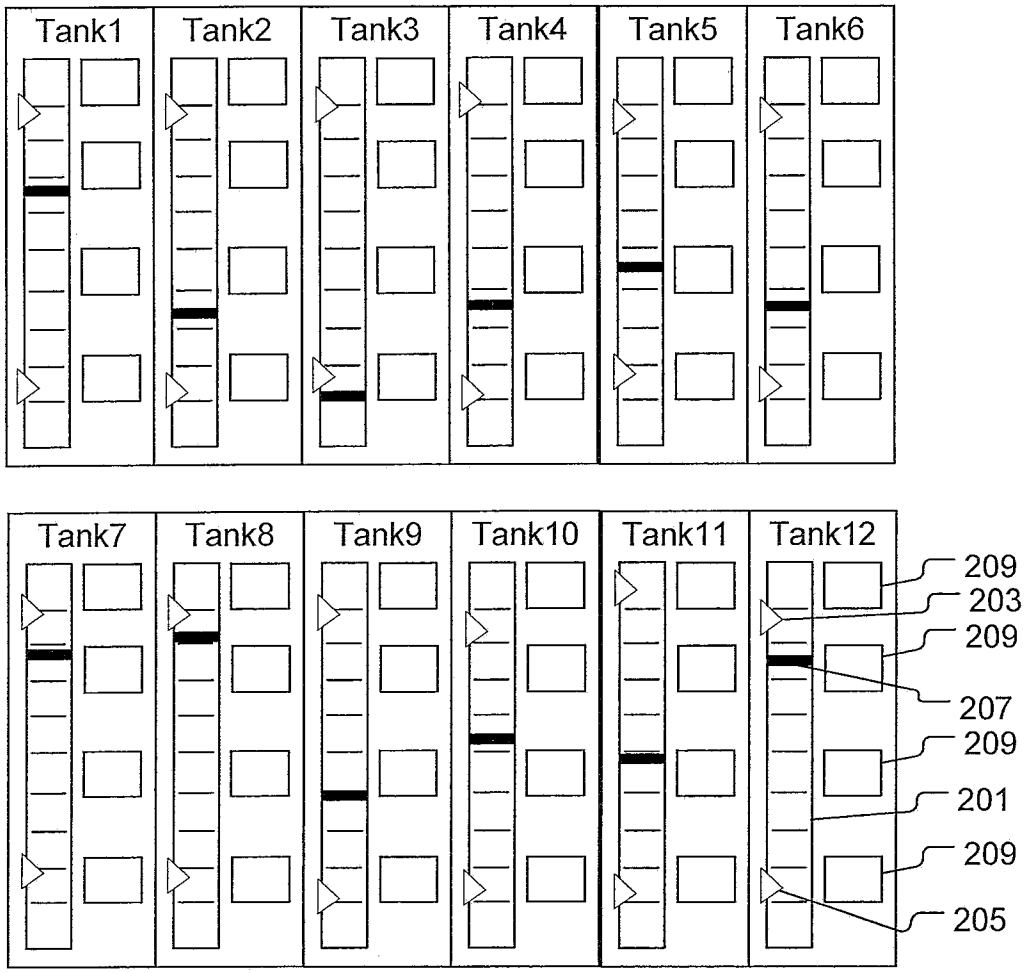
FIG. 6 is a diagram of a controller screen from a system for automatically fueling hydraulic fracturing equipment with the ability to report fuel tank status, usage, and fill level according to the present application.

Referring now also to FIG. 6 in the drawings, a preferred embodiment of display screen for automatically providing fuel to saddle tanks of hydraulic fracturing equipment according to the present application is illustrated. Control system 109 displays conditional information to a screen mounted to the platform. This allows users to glance at the platform and assess the condition of the system. Each tank is represented by a bar chart 201 scaled to the saddle tank capacity. High mark 203 displays the stop filling position of the system associated with tank 12. Once the fuel level is at the high mark the valve 115 closes to stop fuel flow into the saddle tank. Low mark 205 displays the start filling position of the system associated with tank 12. Once the fuel level is below the low mark the valve 115 opens and fuel flows into the saddle tank. Tank level 207 displays the relative position of the fuel level scaled. As an example, Tank 3 requires additional fuel to be added to the saddle tank because the fuel level is below the low mark as set by the user. Additionally indicators 209 display information such as pressure, flow, quantity, and valve position to the user. Each tank is separately controlled and monitored to allow users to customize the system based on the type of frac equipment, the type of saddle tank, the user's preferences, frac equipment issues or problems.

Figure 7:
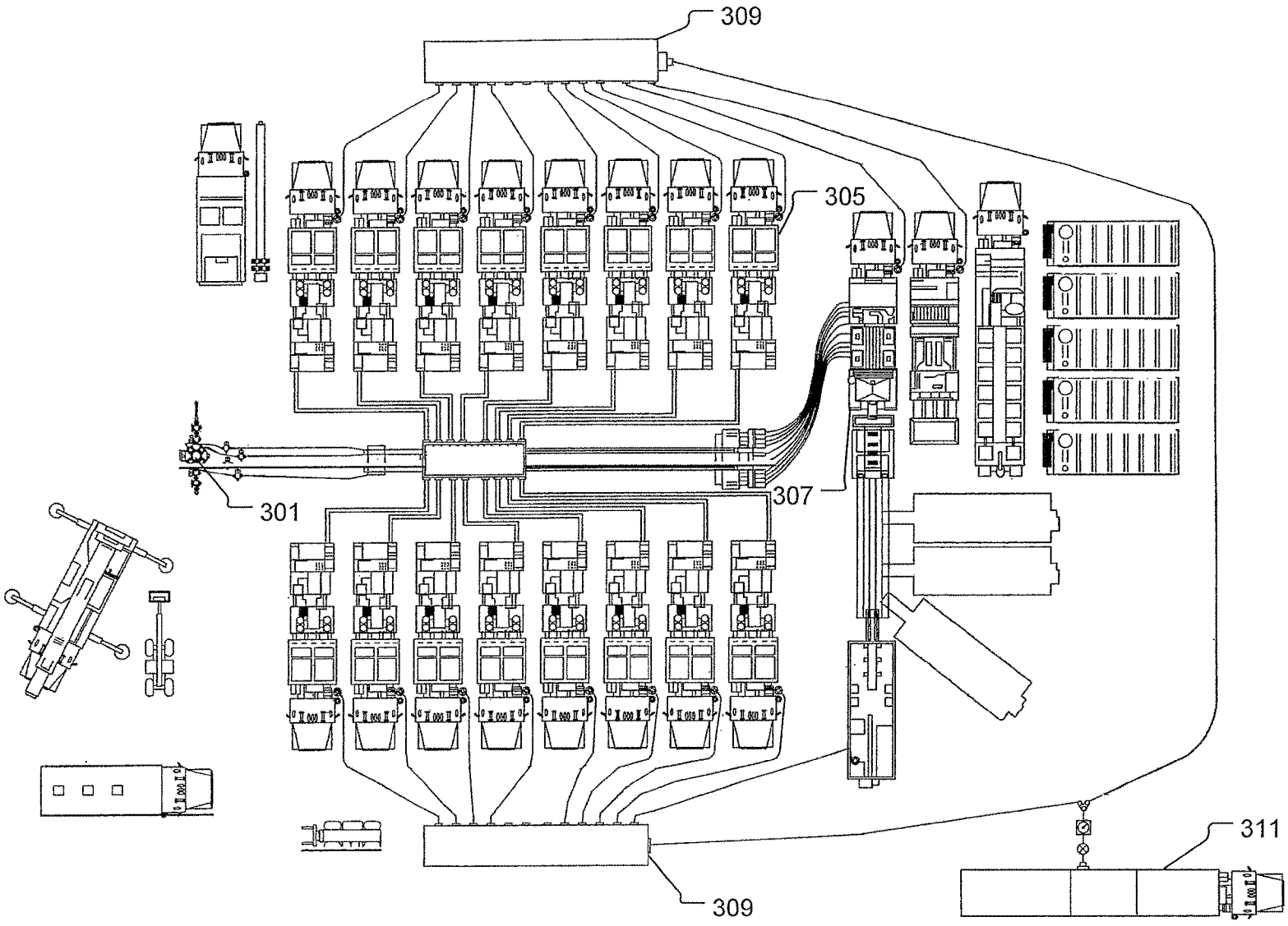
FIG. 7 is a well site diagram of a system for automatically fueling hydraulic fracturing equipment with the ability to report fuel tank status, usage, and fill level according to the present application.
Figure 8:
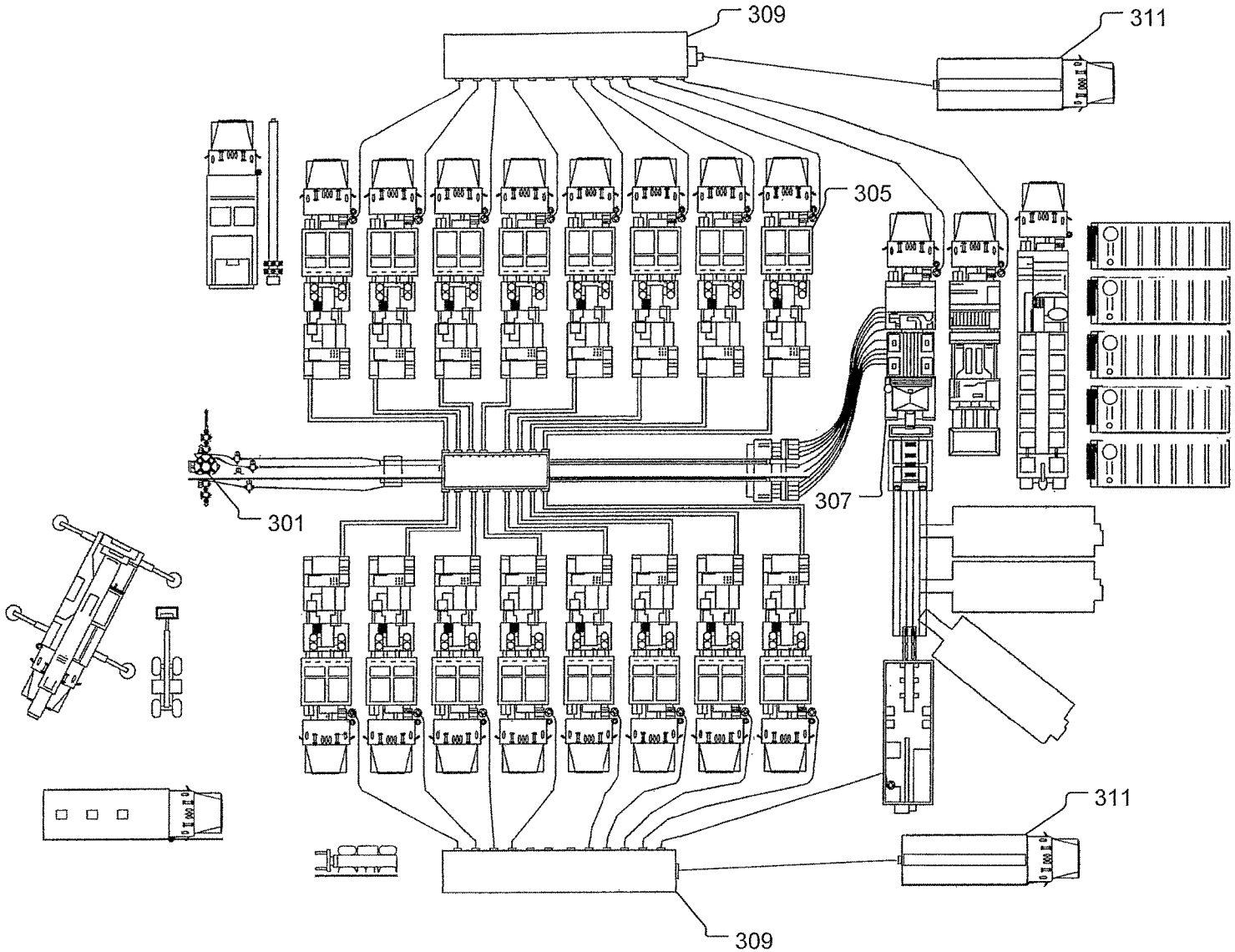
FIG. 8 is a well site diagram of a system for automatically fueling hydraulic fracturing equipment with the ability to report fuel tank status, usage, and fill level according to the present application.

Referring now also to FIGS. 7 and 8 in the drawings, embodiments of mobile cart layouts for automatically providing fuel to saddle tanks of hydraulic fracturing equipment according to the present application are illustrated. A frac site for oil and gas wells are a congested place during the time of fracturing the well. A well head 301 is connected to a plurality of frac pumps 305 and blender/chemical trailers 307. To operate the various pumps and trailers require refueling of their diesel tanks. A mobile fueling platform 309 is located near the frac pumps 305. Preferably the platform is moved into position by driving it into position as described above however the platform can be pulled or forked into position.

A fuel cap system is installed into each saddle fuel tank. A hose is extended from each reel as needed and coupled to the fuel cap system. Additionally, a hose is extended from the cart to the supply tank 311. Calibration of the sensors as needed is performed. The user then allows the controller to control the remotely controlled valve by flipping a switch or depressing a button. The system then autonomously fills the saddle tanks from the supply tank 311. A sale meter is located between the supply tank and the cart to document the volume of fuel sold. Once the frac job is complete the process is reversed. The extended hoses are decoupled and retracted into the cart. The fuel caps are removed from the saddle tanks. Additionally this orientation of carts exterior to the frac pumps allows for the removal of equipment during a fire and the fuel lines can be removed from the pieces of equipment and the cart and extended hoses driven away from the fire.

While the system as illustrated in FIG. 7 is shown with two carts or platforms 309 and one supply tank 311. An alternative embodiment combines the two platforms and the supply tank into a single trailer for providing automatic fueling to an entire well site. Additionally as shown in FIG. 8 the system can be comprised of two carts or platforms 309 and two supply tanks 311.

Figure 9:
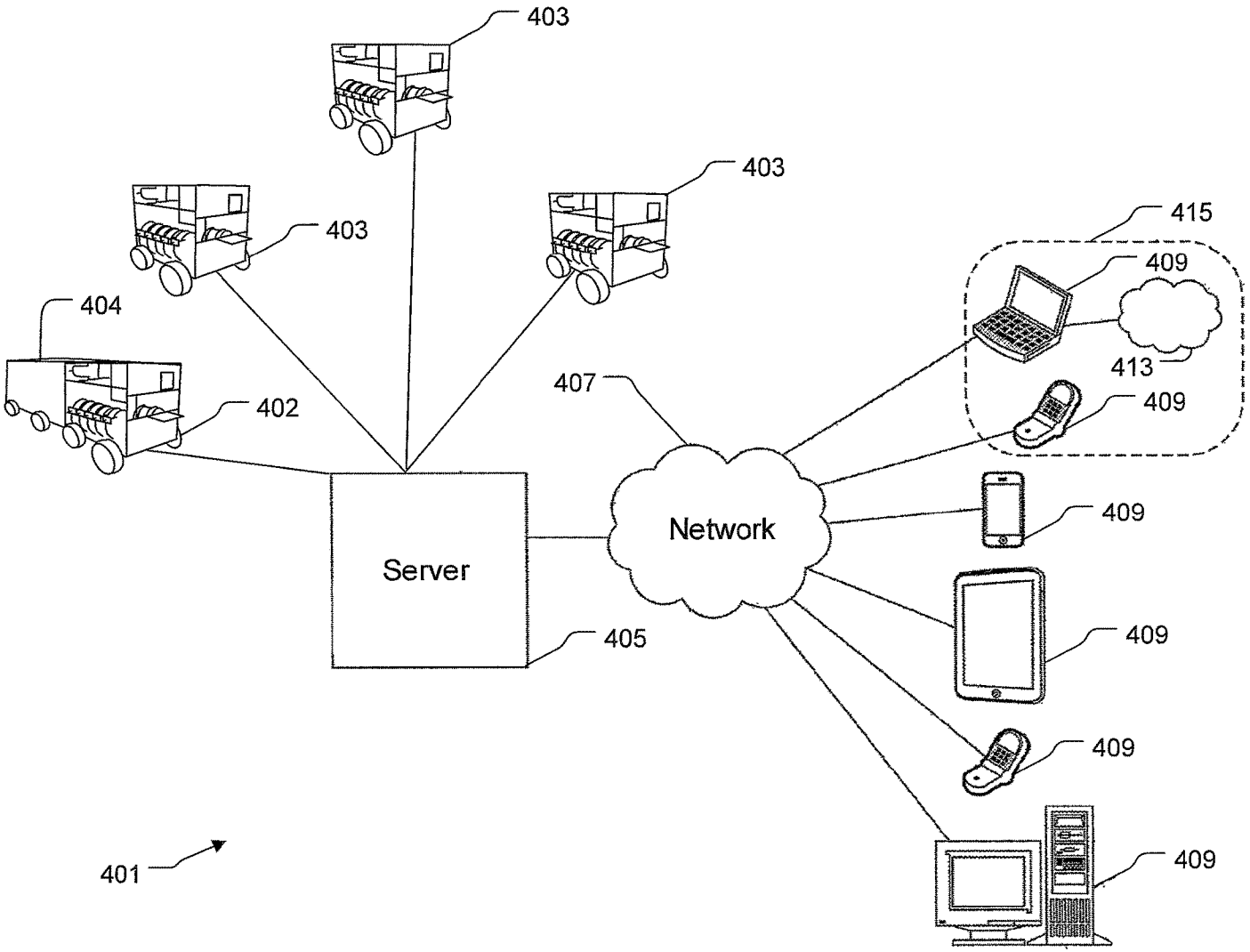
FIG. 9 is a diagram of a system for automatically fueling hydraulic fracturing equipment with the ability to report fuel tank status, usage, and fill level according to the present application.

Referring now also to FIG. 9 in the drawings, an embodiment of a mobile cart system for automatically providing fuel to saddle tanks of frac pumps with real-time fuel reporting according to the present application is illustrated. Reporting system 401 is comprised of a plurality of carts 403, a server 405, a cloud interface 407, and a plurality of connected reporting devices 409. Some connected reporting devices 409, having a unique interface 413, are combined into an enterprise system 415. The plurality of connected reporting devices 409 is comprised of laptops, cellular phones, smartphones, tablets, desktop computers. Enterprise system 415 is configured for providing specialized information for an end user. For example, a first enterprise system can be configured for an operating company and a second enterprise system can be configured for a drilling company. Each enterprise system utilizes a different user interface to provide specific information required by the enterprise. The carts 403 are connected to the server 405 such that data from the sensors of each cart is transmitted to the server. The connection is preferably wireless, however, wired connections are contemplated by this application. Furthermore, the plurality of connected reporting devices is connected to the server 405 by a cloud network 407. Thereby a user can remotely track and monitor fuel status from several frac sites from a single place or check the other frac sites from a first frac site.

The reporting system takes the data from the sensors and provides real-time tracking of fuel usage from the embedded sensors. The reporting system is also able to provide users with time histories of fuel usage such as an amount of fuel usage over a stage of a frac; an amount of fuel usage over a day; an amount of fuel usage over a job; and an amount of fuel in the saddle tank. Additionally, the reporting system can provide the amount of fuel in each of the saddle tanks and the supply tanks. Additionally, the reporting system allows a user remote control of the electric valves of the system. For example, a user can sit in their vehicle remotely viewing the fuel levels in a saddle from their laptop and open/close valves from the laptop to add or stop fuel from being added to the monitored tank. Furthermore, a semi-automatic mode is contemplated, such that the electric valve system closes once the fuel level reaches a selected high value in the tank or when the high sensor is activated. The operator would be alerted once the fuel level reached a selected low point and the operator would remotely activate the electric valve to open and start fuel flowing into the saddle tank of the piece of equipment.

Figure 10:
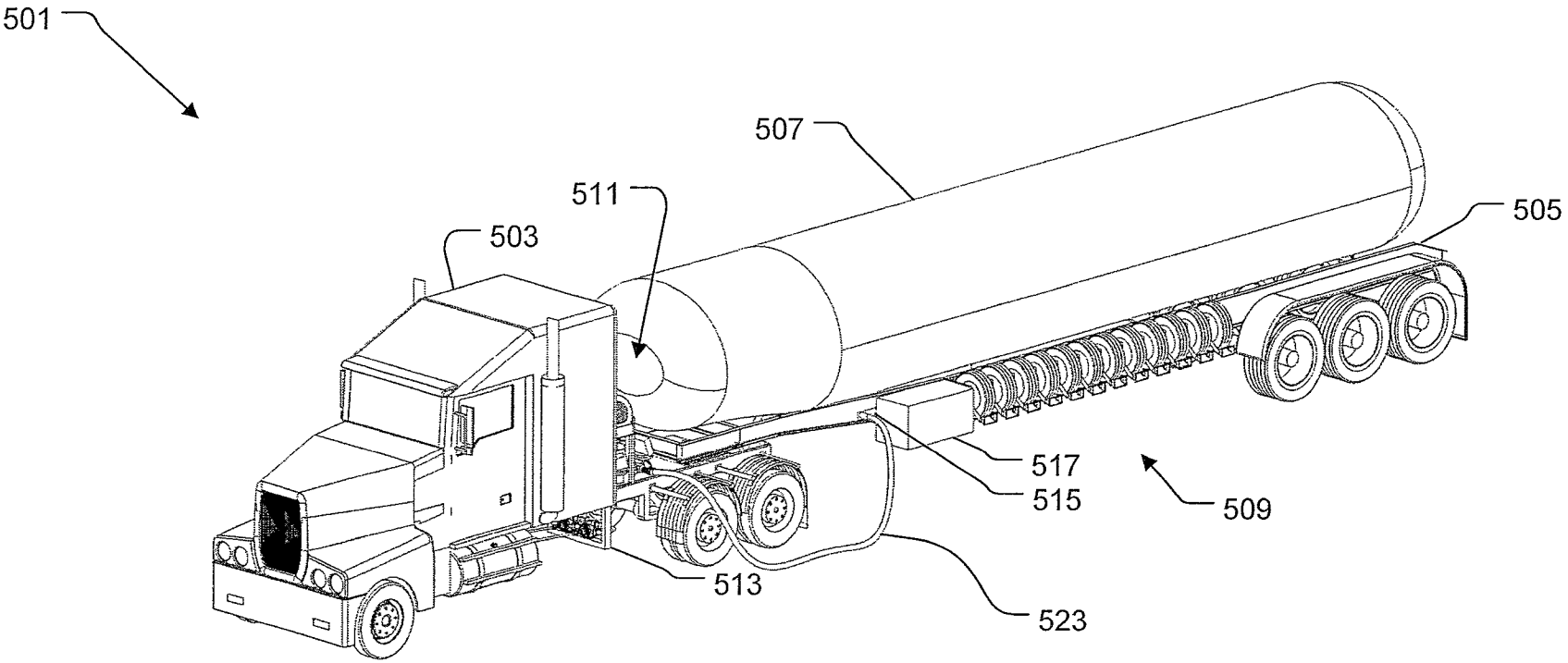
FIG. 10 is a generally downward perspective view of a system for automatically fueling hydraulic fracturing equipment with the ability to report fuel tank status, usage, and fill level on a fuel transport according to the present application.
Figure 11:
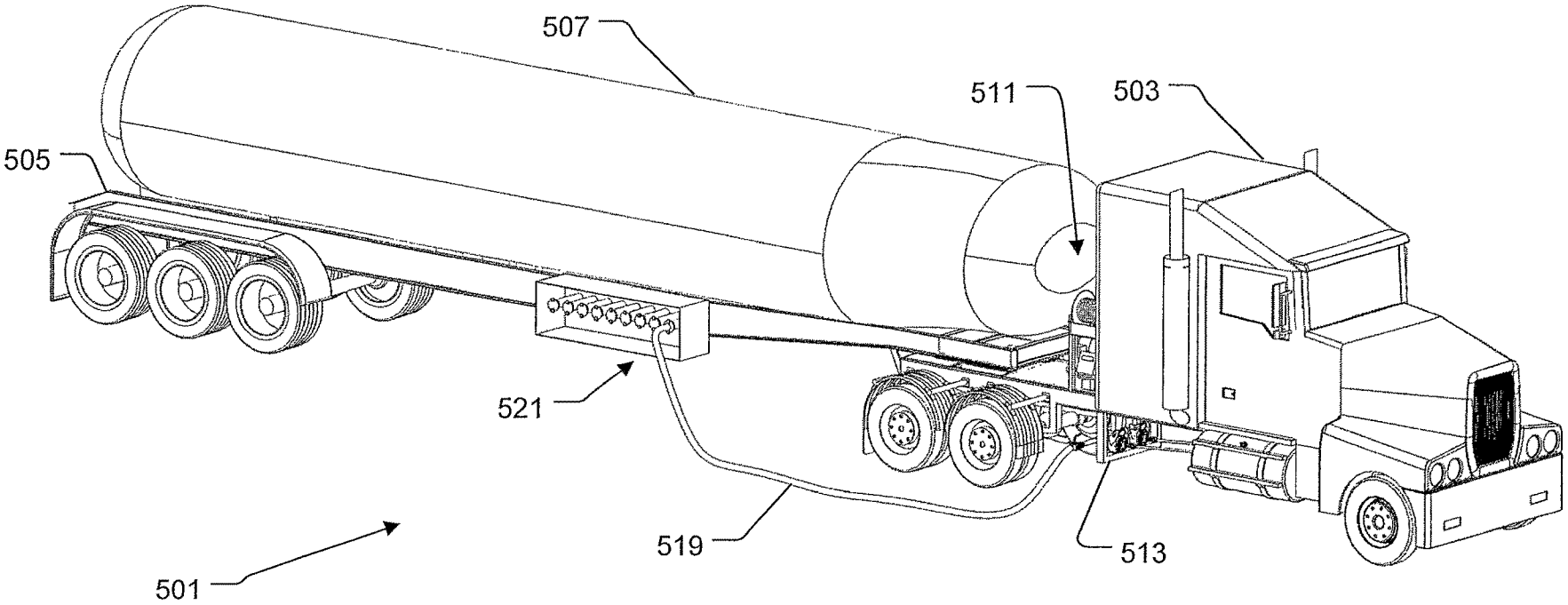
FIG. 11 is a generally downward perspective view of a system for automatically fueling hydraulic fracturing equipment with the ability to report fuel tank status, usage, and fill level on a fuel transport according to the present application.

Referring now to FIGS. 10-11 in the drawings, an alternative embodiment of mobile fueling platform for automatically providing fuel to a saddle tank of the frac equipment according to the present application is illustrated. System 501 is comprised of a truck cab 503, a trailer 505, a high capacity fuel tank 507 located on the trailer, a first plurality of fuel reels 509, a pump station 511, a pair of fuel pumps 513, a fuel manifold 515, and a controller 517. Pump station 511 is comprised of a second plurality of fuel reels having larger diameter hoses than the hoses of the first plurality, a manifold, electronic valves, meters, sensors, and emergency valves electrically coupled to the controller of the cart. The pump station 511 is configured to provide fuel to a single cart or pair of carts of system 101 from the second plurality of fuel reels. Pump station 511 is fluidly connected to the pumps and the fuel tank 507.

Fuel is removed from the fuel tank 507 by first hose 519 being fluidly coupled to a port 521 of a multiport on the trailer and fluidly coupled to the pair of pumps 513. Pumps 513 are preferably mechanically driven by a power take-off system of the truck cab 503 and can be electrically or mechanical switched on and off. Alternatively, the pumps can be electrically driven by a local power supply or a remote power supply. Furthermore, a fuel meter is located between the fuel tank 507 and the reels to measure the amount of fuel removed from the tank 507. Second hose 523 fluidly couples the pumps to the fuel manifold 515. Fuel manifold 515 and the first plurality of reels 509 is similar to that of system 101 and used to fuel tanks of frac pumps directly with electronic valves controlled by controller 517 located between the reels and the manifold. System 501 can be driven to the well site and located adjacent the frac pumps. System 501 provides metered and controlled fuel to each saddle tank of the frac pumps and additionally provide fuel to the carts as described above. The compact nature of the truck and tank combined make transport easier around a congested well site.

Figure 12:
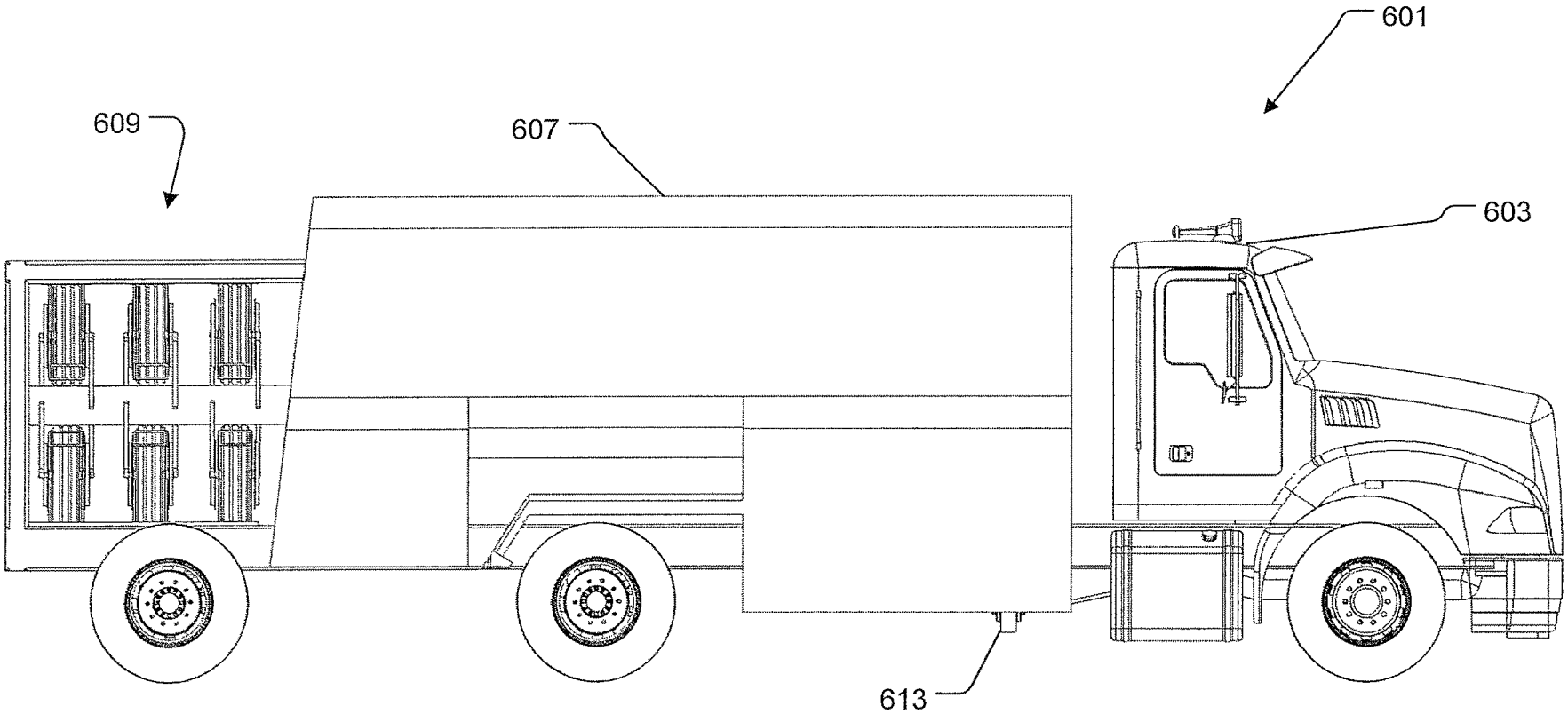
FIG. 12 is a side view of a system for automatically fueling hydraulic fracturing equipment with the ability to report fuel tank status, usage, and fill level on a fuel bobtail according to the present application.
Figure 13:
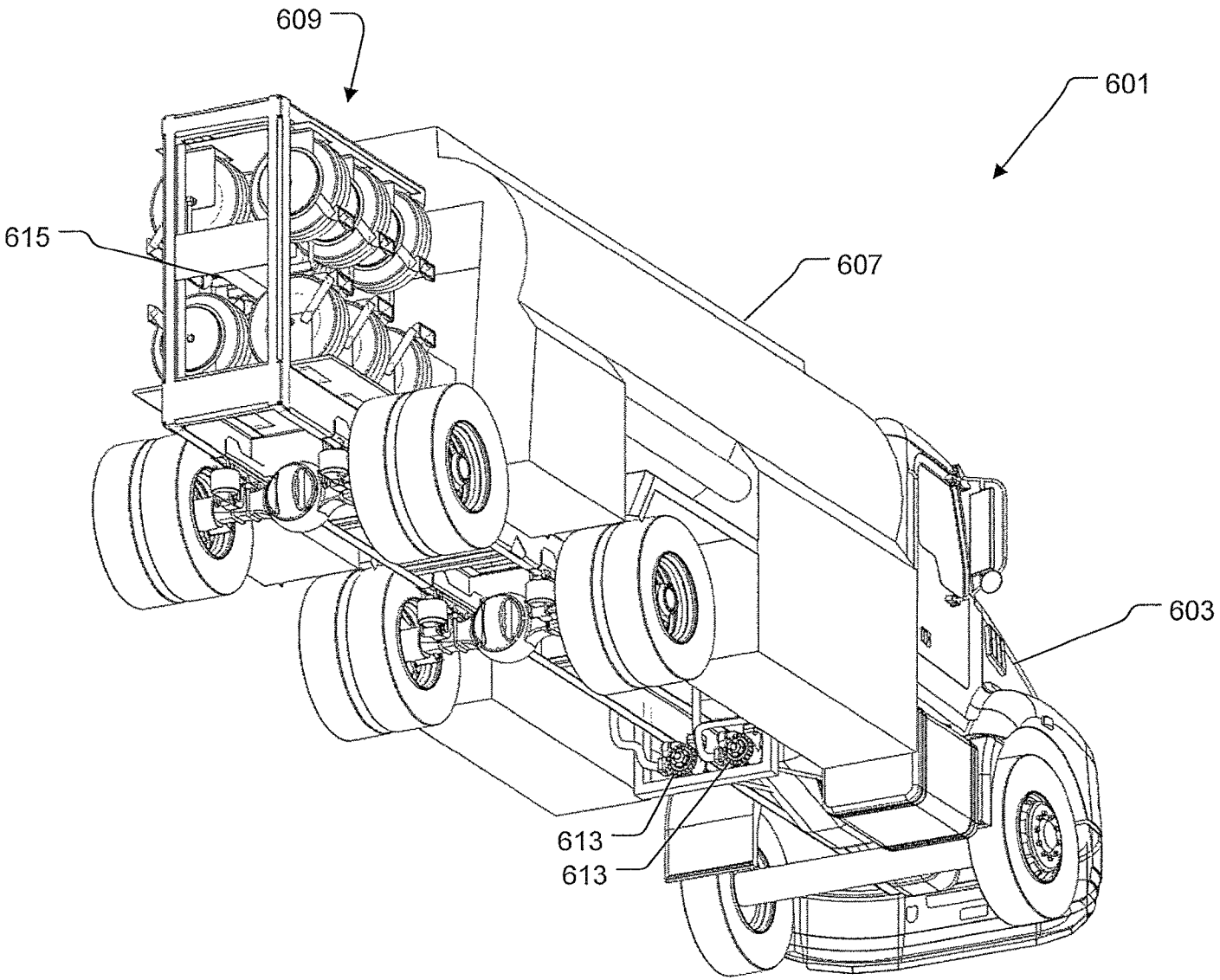
FIG. 13 is a generally upward perspective view of a system for automatically fueling hydraulic fracturing equipment with the ability to report fuel tank status, usage, and fill level on a fuel bobtail according to the present application.

Referring now also to FIGS. 12-13 in the drawings, an alternative embodiment of mobile fueling platform for automatically providing fuel to a saddle tank of the frac equipment according to the present application is illustrated. System 601 is comprised of a bobtail truck 603, a medium capacity fuel tank 607 integrally located on the truck, a first plurality of fuel reels 609, a pair of fuel pumps 613, a fuel manifold 615, and a controller. Fuel tank 607 typically has a capacity of four thousand gallons ±two thousand gallons. Pumps 613 are preferably mechanically driven by a power take-off system of the truck engine and can be electrically or mechanical switched on and off. Alternatively, the pumps can be electrically driven by a local power supply or a remote power supply. System 601 can be driven to the well site and located adjacent the frac pumps and provide metered and controlled fuel to each saddle tank of the frac pumps.

Figure 14:
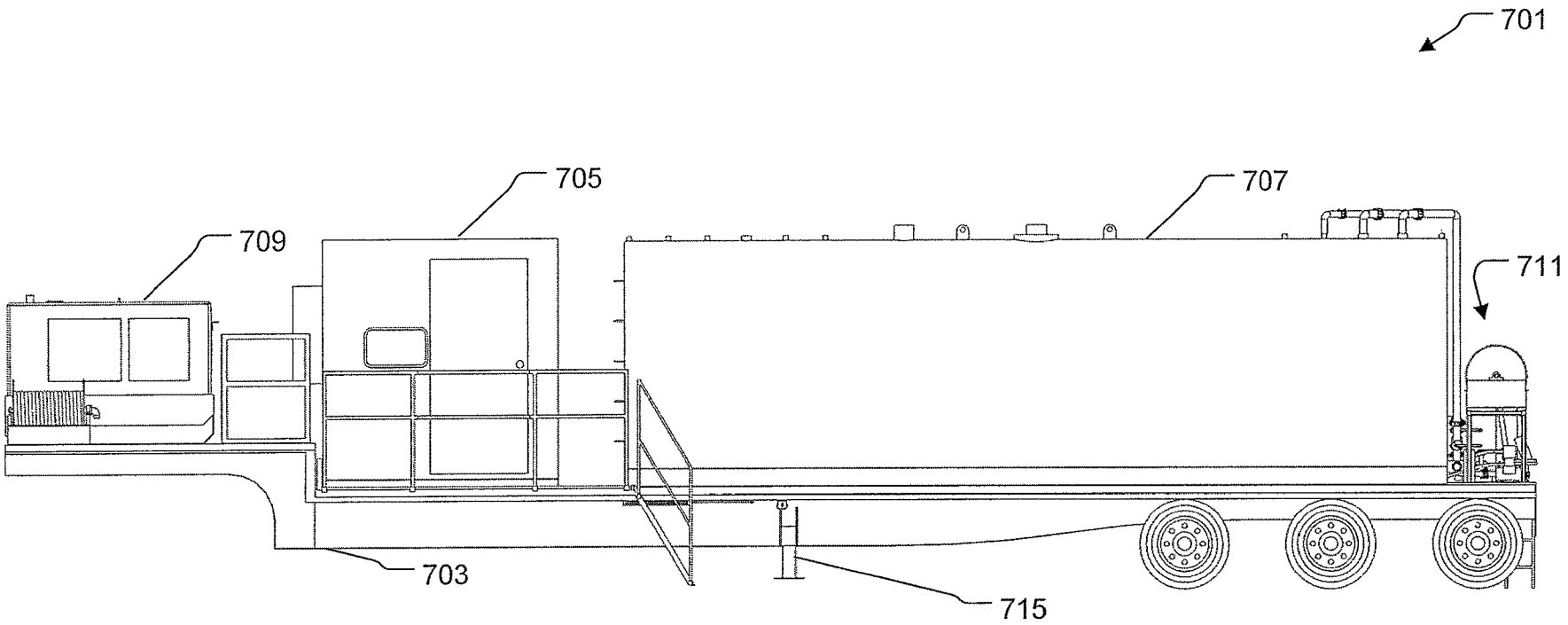
FIG. 14 is a side view of a system for automatically fueling hydraulic fracturing equipment with the ability to report fuel tank status, usage, and fill level on a fuel shuttle according to the present application.
Figure 15:
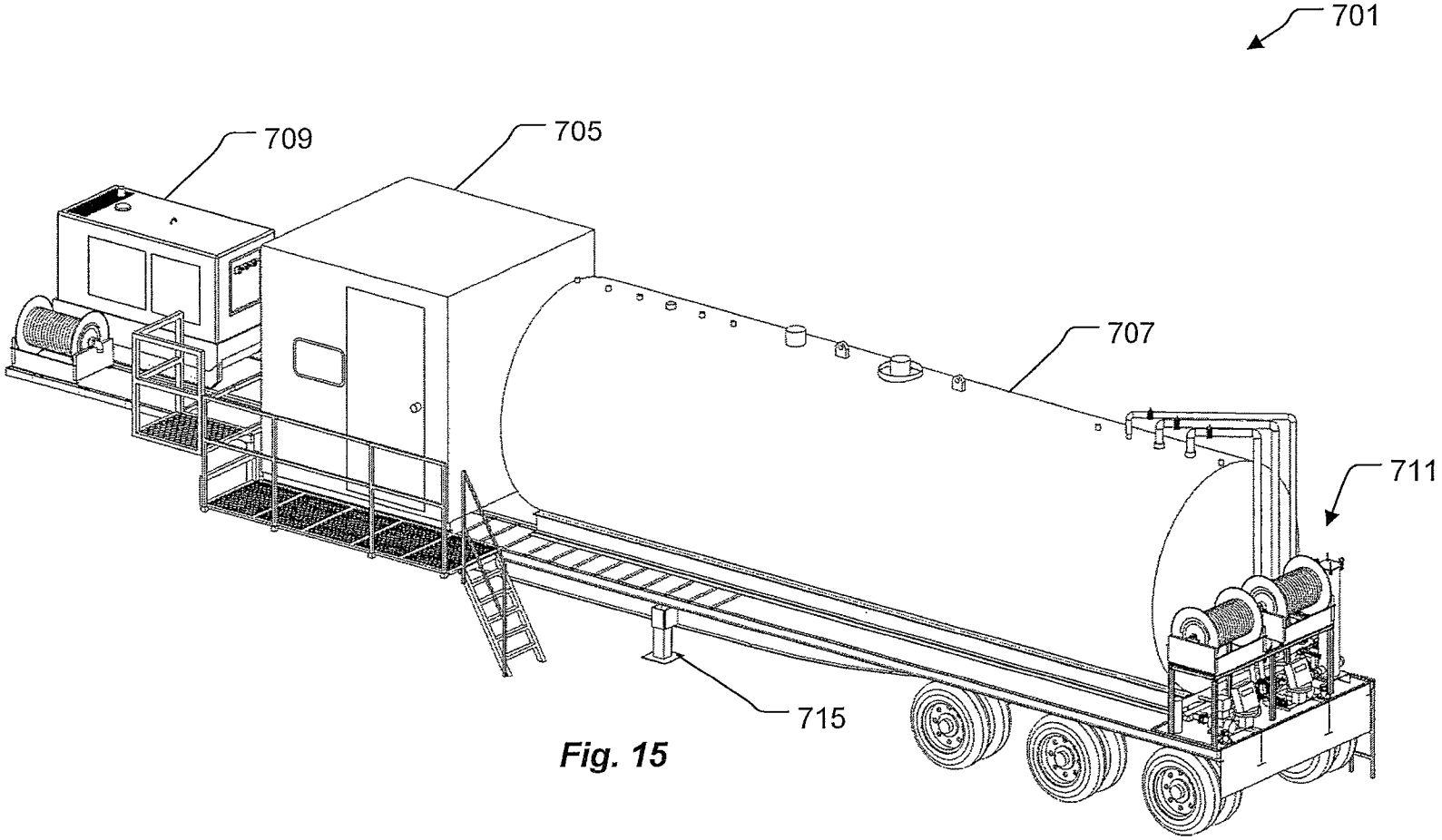
FIG. 15 is a generally downward perspective view of a system for automatically fueling hydraulic fracturing equipment with the ability to report fuel tank status, usage, and fill level on a fuel shuttle according to the present application.
Figure 16:
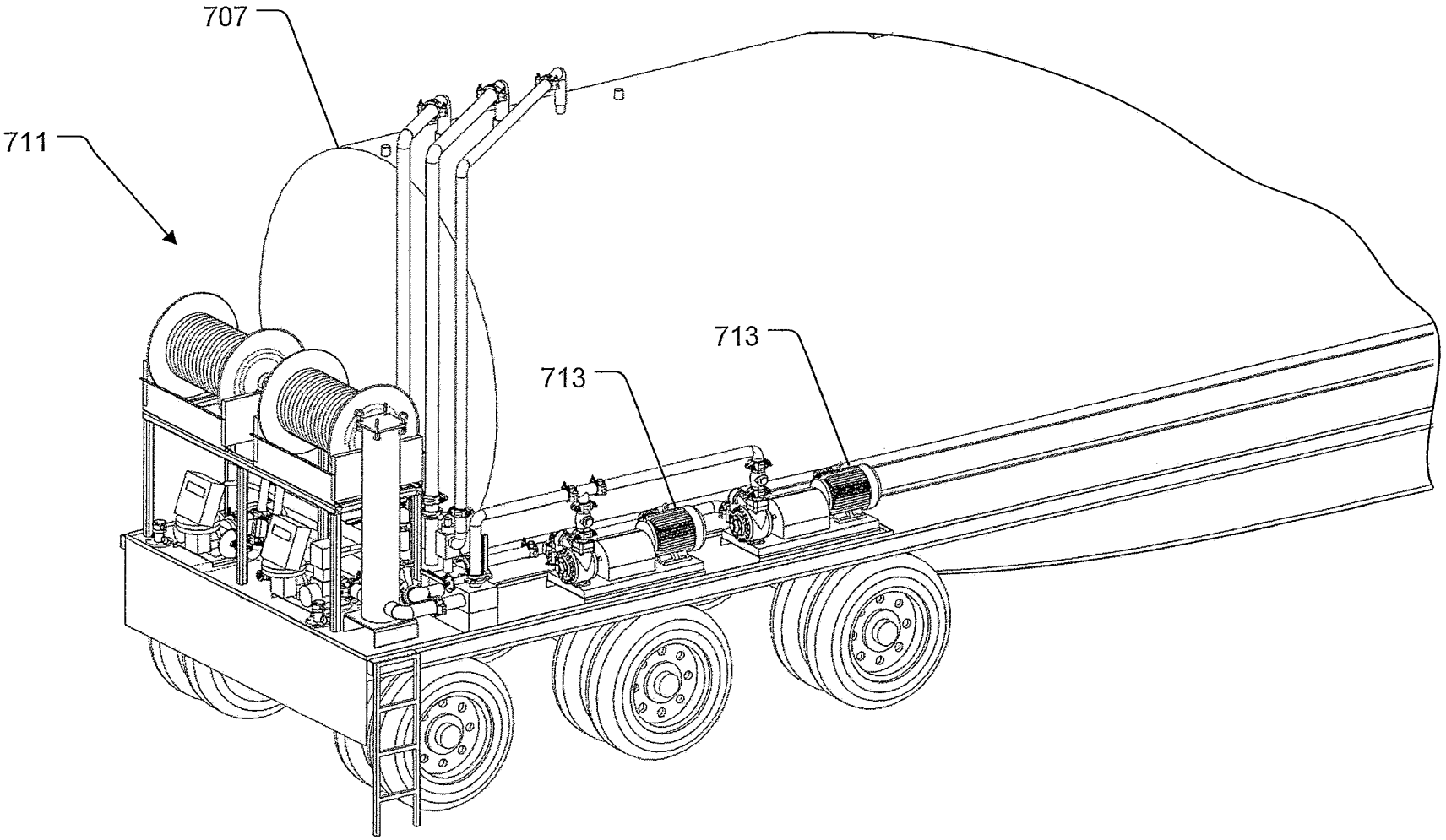
FIG. 16 is a generally downward partial perspective view of a system for automatically fueling hydraulic fracturing equipment with the ability to report fuel tank status, usage, and fill level on a fuel shuttle according to the present application.

Referring now also to FIGS. 14-16 in the drawings, an alternative embodiment of mobile fueling platform for automatically providing fuel to a saddle tank of the frac equipment according to the present application is illustrated. System 701 or fuel shuttle is comprised of a trailer 703, a cabin 705, a large capacity fuel tank 707 integrally located on the shuttle, a generator 709 for producing electrical power, a pump station 711, a pair of fuel pumps 713, and an auxiliary fuel reel for the generator 709 and other miscellaneous equipment located adjacent the generator. System 701 can be driven to the well site and located adjacent the frac pumps and provide metered and controlled fuel to a pair of fuel carts as described above. Fuel tank 707 is doubled walled and typically has a capacity of ten thousand gallons ±two thousand gallons.

Pump station 711 is comprised of a pair pf redundant systems, each system having a fuel reel, a meter, and a series of fittings to fluidly couple the tank 707 to the reel and ultimately to the cart. The cabin is comprised of a structure that the users can be located inside of during use and provides electrical connections and data connections for laptop control of system 101. Folding platforms surround the cabin and are unloaded at the well site. Additional controls are located in the cabin such as breaker panel for the generator 709 and switches for pumps 713. A battery system can be located on the shuttle for storage of energy to the various connected subsystems.

Generator 709 is a diesel driven three phase and single phase electrical providing system. Generator 709 electrically powers pumps 713 and cabin 705 along with lighting as necessary on the shuttle. Furthermore, generator 709 can power carts 101 with an extension cable. A pair of actuated struts 715 supports the system 701 when the cab of the truck has left system 701 at a well site.

Figure 17:
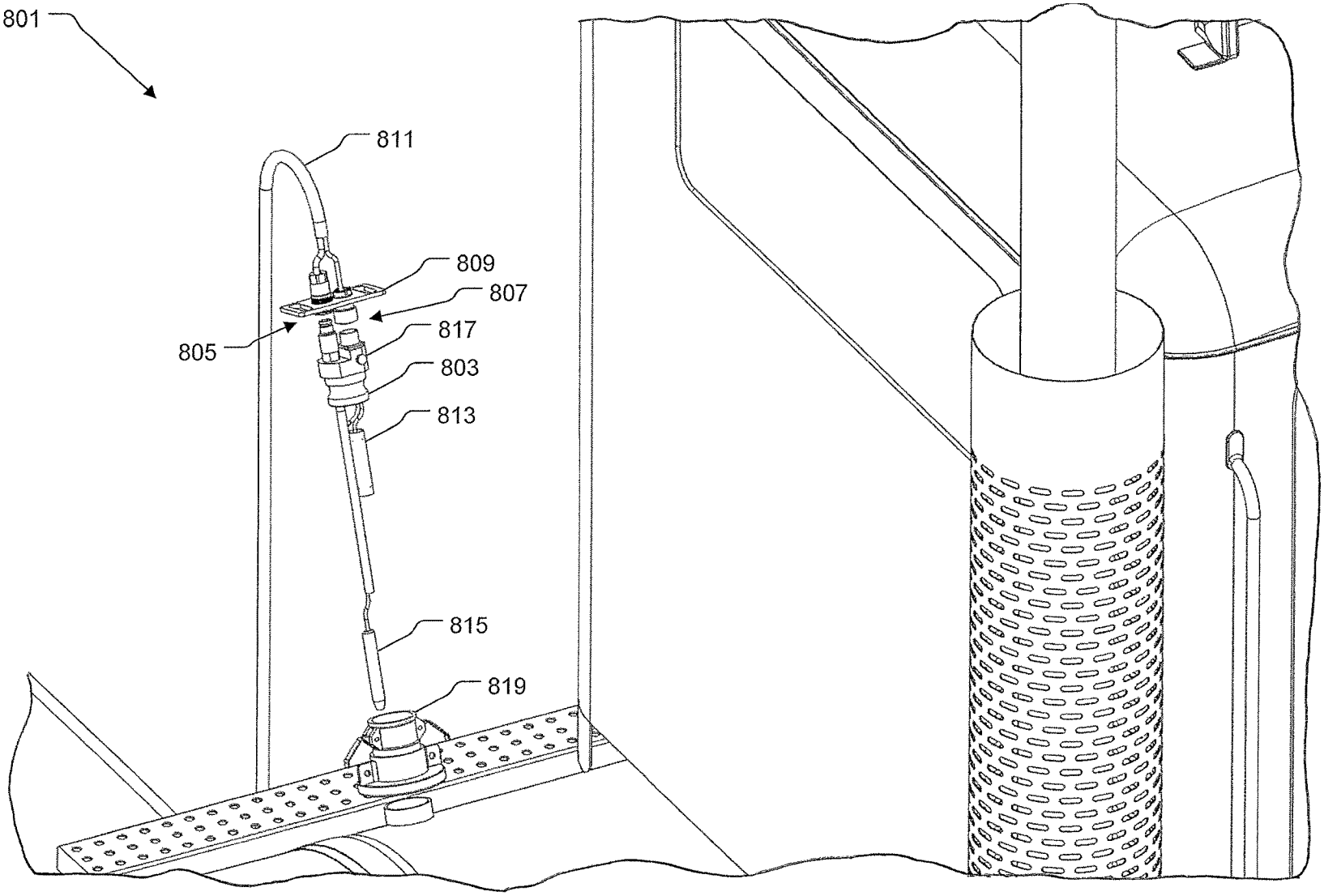
FIG. 17 is a generally downward perspective view of a fuel cap system of a system for automatically fueling hydraulic fracturing equipment with the ability to report fuel tank status, usage, and fill level according to the present application.
Figure 18:
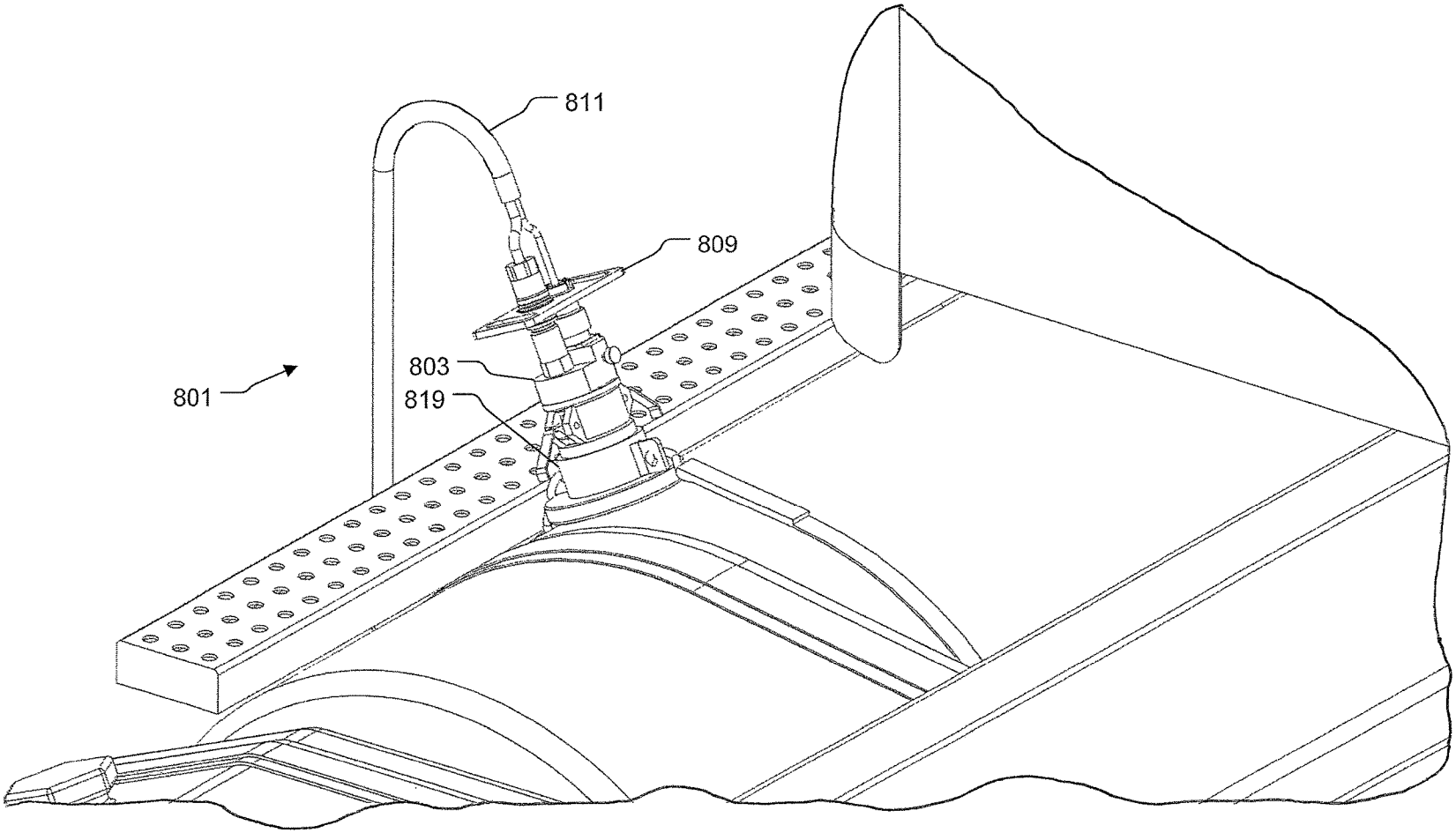
FIG. 18 is a generally downward perspective view of a fuel cap system of a system for automatically fueling hydraulic fracturing equipment with the ability to report fuel tank status, usage, and fill level according to the present application.

Referring now also to FIGS. 17-18 in the drawings, a preferred embodiment of fuel cap system of a mobile fueling platform for automatically providing fuel to a saddle tank of the frac equipment according to the present application is illustrated. Fuel cap system 801 or stinger is comprised of a base 803, a hydraulic coupler 805, for example, a dry break fitting, an electrical coupler 807, a plate 809, a wired hose 811, a high sensor 813, a low sensor 815, a vent tube 817, and a base retainment member 819.

The base retainment member 819 is placed where the fuel tank cap would normally be located on the saddle tank of the frac pump. The base retainment member 819 is strapped in place by a strap that goes around the circular tank and picks up openings in the base retainment member 819, the tension of the strap holds the base retainment member 819 in place relative to the saddle tank. The base retainment member 819 has a gasket for sealing with the saddle tank. The base retainment member 819 has a pair of cam-style levers to retain the base 803 in place. The base retainment member 819 also has a gasket for sealing with the base 803.

The base 803 is comprised of machined aluminum and features a series of passages from the exterior of the saddle tank to the interior of the saddle tank, as well as, a groove located around a circumference of the base to engage the levers of the base retainment member. A first portion of the hydraulic coupler is located on the base. A first portion of the electrical coupler is located on the base, for example, the electrical receptacle. A fill pipe is coupled to the base to be inserted into the saddle tank. Fuel comes out of the hose through the hydraulic coupler, the base, and the fill pipe and into the saddle tank.

Both the high sensor 813 and the low sensor 815 are electrically connected to the controller across the electrical coupler 807. The high sensor 813 of the fuel cap system is configured to measure the amount of fuel in the saddle tank near the rated capacity of the tank. The low sensor 815 of the fuel cap system is configured to measure the entire amount of fuel in the saddle tank. The high sensor is preferably an ultrasonic sensor and alerts the system once the fluid level in the tank is high enough to break an ultrasonic beam. The low sensor is preferably a pressure sensor and is submerged into the fluid. As the tank is filled the pressure increases. The high sensor is a redundant sensor to ensure that the valve is closed when the fuel level in the tank approaches the tank's capacity. Low sensor 815 provides data to the system in order for the tank fill level to be reported.

Plate 809 rigidly retains a second portion of the hydraulic coupler and a second portion of the electrical coupler. Plate 809 features a set of handles or openings to allow the user to easily grab the plate and couple and decouple the fuel and electrical connections.

Figure 19:
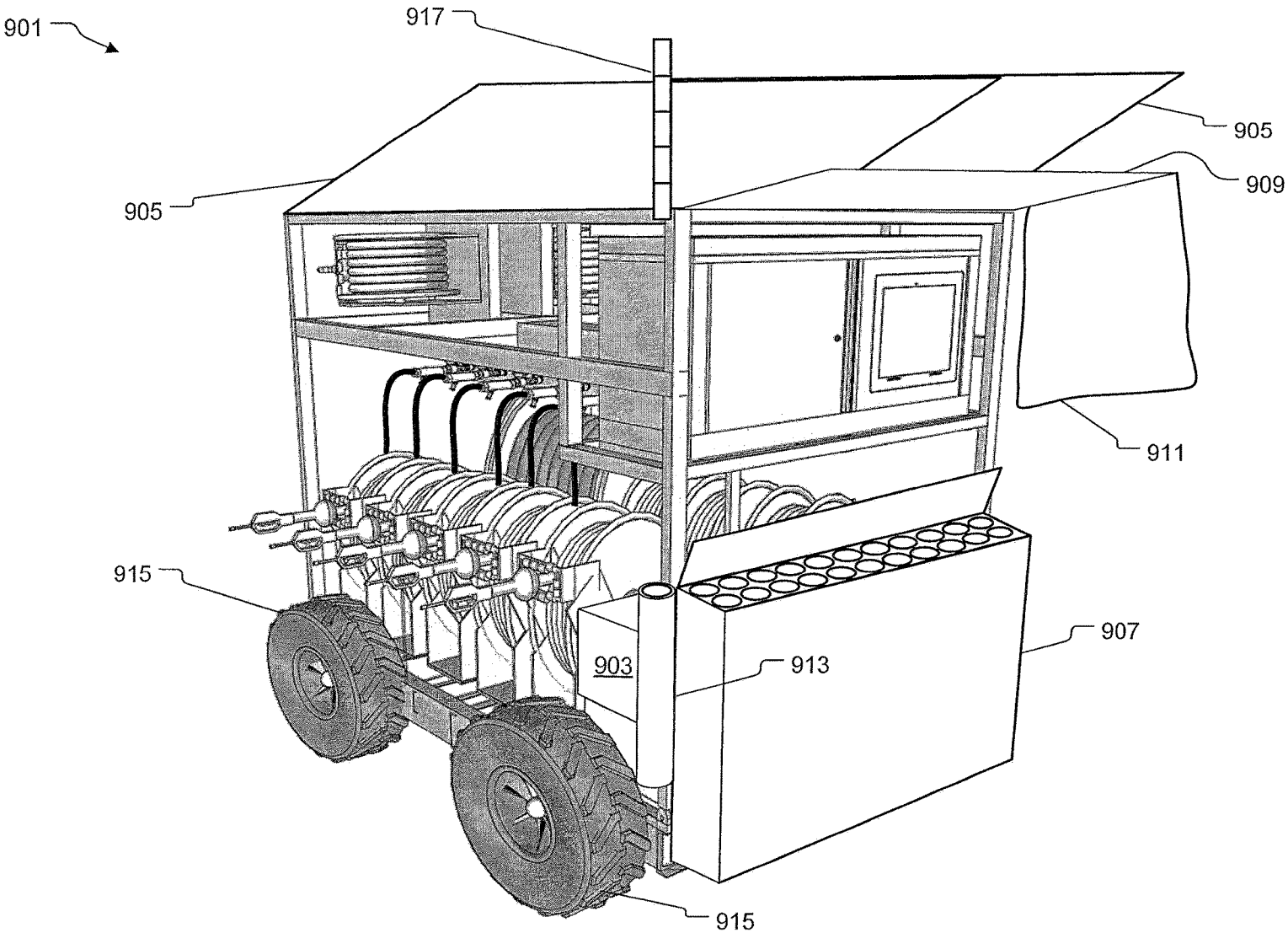
FIG. 19 is a generally downward perspective view of an electrically powered system for automatically fueling hydraulic fracturing equipment with the ability to report fuel tank status, usage, and fill level according to the present application.

Referring now also to FIG. 19 in the drawings, an alternative embodiment of a mobile fueling platform for automatically providing fuel to a saddle tank of the frac equipment according to the present application is illustrated. System 901 is an improved version of system 101 and further comprises electric power instead of hydraulic, a generator 903 for producing electricity, a solar system 905 for charging batteries associated with the electrical system, a fuel cap storage container 907, an awning 909, a sunscreen 911, and a calibration vessel 913. Awning 909 rotates about a hinge along an edge of the cart. While sunscreen 911 is illustrated as only closing a portion of the awning, it should be apparent that the sunscreen may be larger and go around a perimeter of the awning. Typically sunscreen 911 is magnetically coupled to the awning.

System 901 further comprises a propulsion system having an electric motor mechanically driving a pair of the wheels 915 with a drivetrain, a mechanical actuator coupled to the wheels 915 of the system of the front wheel steer system. Furthermore, the unit can be moved by a remote control that operates the electric motor and the actuator to steer the wheels 915. With the remote control, the user can drive the unit around the job site and steer clear of obstacles in the confined spaces around a fracturing site.

Calibration vessel 913 is typically a fuel filled tube having a depth similar to the depth of typical saddle tanks. The user inserts the fuel cap system into the calibration vessel to verify operation of all sensors associated with the fuel cap system and to calibrate a portion of the sensors or all the sensors associated with the fuel cap system. Each fuel cap system for each saddle tank is verified and calibrated with the wiring associated with the specific fuel cap or stinger.

System 901 further comprises a light tower 917 attached to the cart for displaying conditional information regarding the fueling to users all around the cart and the frac site. System 901 further comprises a plurality of drain pan sensors located near the wheels 915 inside the cart. The drain pan sensors detect leaking liquid from the cart and are wired to the controller to act as an emergency stop upon detection of leaking fluid in the drain pan of the cart.

Figure 20:
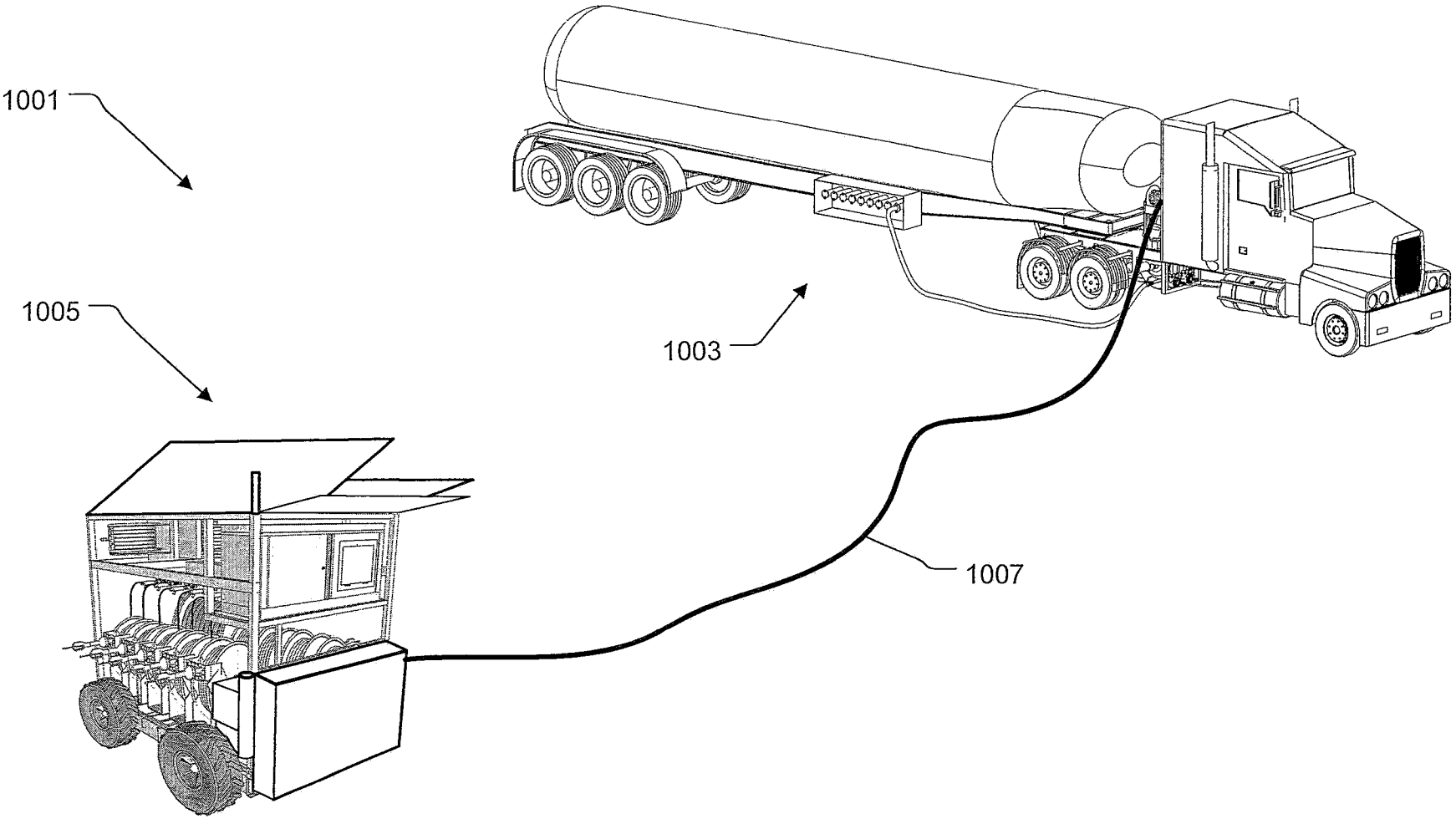
FIG. 20 is a generally downward perspective view of a system for automatically fueling hydraulic fracturing equipment with the ability to report fuel tank status, usage, and fill level according to the present application.

Referring now also to FIG. 20 in the drawings, an alternative embodiment of a mobile fueling platform for automatically providing fuel to a saddle tank of the frac equipment according to the present application is illustrated. System 1001 is comprised of a fuel transport 1003 and a fuel cart 1005. Fuel transport 1003 is fluidly and electrically connected to fuel cart 1005 with hose 1007. Fuel flows from the tank of the fuel transport through the fuel station of the fuel transport through the hose 1007 and into the fuel cart 1005 to be supplied to a saddle tank of a frac pump. The controller of the fuel transport is wired through the hose to an electric valve of the fuel station of the fuel transport and can stop the flow of fuel from reaching the fuel cart. Fuel transport 1003 typically has a capacity of nine thousand five hundred gallons ±two thousand gallons but due to transportation issues is typically filled to seven thousand five hundred gallons.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is, therefore, evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments but are amenable to various changes and modifications without departing from the spirit thereof.

The invention claimed is:

1. A mobile fueling platform for filling a saddle tank and reporting the saddle tank usage, comprising:

a single fuel input system, comprising:

a hose reel; and an input fuel hose disposed on the hose reel;

wherein the input fuel hose is retractable;

a plurality of fuel output systems, each fuel output system, having:

an output fuel hose;

an output reel configured for storing the output fuel hose; and an electrically actuated valve coupling the single fuel input system to the plurality of fuel output systems;

wherein the electrically actuated valve is a remote actuated valve;

a controller electrically connected to the electrically actuated valve;

a remote control configured for controlling at least one of a hydraulic system and, an electrical system, and the remote actuated valve;

a propulsion system located on the platform, the propulsion system configured for moving the platform;

a steering system located on the platform, the steering system configured for steering the platform;

wheels connected to the steering system;

a foldable bracket located on the platform, the foldable bracket configured for a user to stand on while controlling at least one of the steering system and the propulsion system;

wherein the foldable bracket is coupled to the platform above the wheels to allow the user to see over a top of the platform while standing on the foldable bracket;

a low sensor located in the saddle tank adjacent a bottom surface of the saddle tank;

a high sensor located in the saddle tank; and a display to present an amount of fuel based on at least one of the low sensor and the high sensor;

wherein the saddle tank is connected to at least one fuel output system of the plurality of fuel output systems;

wherein the controller controls fuel flow through each fuel output system of the plurality of fuel output systems based upon measurements from both the low sensor and the high sensor;

wherein the high sensor is suspended inside the saddle tank above the low sensor for monitoring a volume of fuel;

wherein the low sensor is positioned below the high sensor and is configured to be within the volume of fuel; and wherein the controller regulates fuel flow by actuation of the electrically actuated valve.

2. The mobile fueling platform according to claim 1, wherein the low sensor is a pressure sensor; and wherein the high sensor is an ultrasonic depth sensor.

3. The mobile fueling platform according to claim 1, wherein the input fuel hose is automatically retractable.

4. The mobile fueling platform according to claim 1, further comprising:

a flow meter located between the single fuel input system and the plurality of fuel output systems.

5. The mobile fueling platform according to claim 1, further comprising:

a fuel supply tank located on the mobile fueling platform.

6. The mobile fueling platform according to claim 1, further comprising:

a reporting system communicatively coupled to the display;

wherein the reporting system is configured to report to the user a fuel status of the saddle tank.

7. The mobile fueling platform according to claim 1, further comprising:

a fuel reservoir located on the platform configured for testing of the first sensor before insertion of the first sensor into the saddle tank.

8. The mobile fueling platform according to claim 1, each fuel output system further comprising:

a ball valve.

9. The mobile fueling platform according to claim 1, each fuel output system further comprising:

a plate for retaining an end of the output fuel hose, the plate located adjacent the saddle tank.

10. The mobile fueling platform according to claim 1, each fuel output system further comprising:

a fuel cap system.

11. The mobile fueling platform according to claim 1, the propulsion system comprising:

the electrical system configured for moving the platform around a drill site.

12. A system for automatically fueling saddle tanks of hydraulic fracturing equipment, comprising:

a server communicatively coupled to a network by way of a cloud interface;

a connected reporting device communicatively coupled to the network by way of the cloud interface;

a cart communicatively coupled to the server, comprising;

a single fuel input system, having;

an input fuel hose; and an input reel;

a plurality of fuel output systems, each having;

an output fuel hose;

an output reel; and a remotely actuated valve;

a propulsion system for independent movement;

a steering system for independent steering;

a foldable bracket configured for a user to stand on while controlling at least one of the steering system and the propulsion system;

wheels connected to the steering system;

wherein the foldable bracket is coupled to the cart above the wheels to allow the user to see over a top of the cart while standing on the foldable bracket;

a controller electrically connected to the each of the remotely actuated valves and at least one of an electrical system and a hydraulic system; and a display configured to display a fuel indication based on at least one of the fuel input system and a fuel output system;

wherein the controller regulates fuel flow by actuation of the valve; and a plurality of fuel cap systems, each having;

a plate rigidly attached to a respective output fuel hose;

a low sensor configured to provide the controller with first data corresponding to a fuel level within a first saddle tank, the low sensor being a pressure sensor inside the first saddle tank; and a high sensor configured to provide the controller with second data corresponding to the fuel level of the first saddle tank, the high sensor being an ultrasonic distance sensor suspended above the low sensor;

wherein the first data and the second data corresponding to the fuel level are provided to the controller.

13. The system according to claim 12, the propulsion system further comprising:

the hydraulic system configured for moving the cart around a drill site.

14. The system according to claim 12, wherein a fluid connection between the output fuel hose and the first saddle tank is located on the plate.

15. The system according to claim 12, wherein an electrical connection between the controller and both the low sensor and the high sensor is located on the plate.

16. The system according to claim 12, the plurality of fuel output systems further comprising:

an electric valve located adjacent the saddle tank.

17. The system according to claim 12, the cart further comprising:

a fuel reservoir located on the cart;

wherein the low sensor and the high sensor are submerged into the fuel reservoir to verify functionality before insertion into the saddle tank.

18. The system according to claim 13, wherein the cart is configured for four wheel drive.

19. The system according to claim 12, the propulsion system further comprising:

an electrical motor configured for moving the platform around a drill site; and the steering system further comprising:

an actuator for steering the platform.

20. The system according to claim 12, further comprising:

a fuel supply connected to the input fuel hose;

wherein the fuel supply is located on a bobtail.

21. The system according to claim 12, further comprising:

a fuel supply connected to the input fuel hose;

wherein the fuel supply is located on a transport.

22. The system according to claim 12, further comprising:

a fuel supply connected to the input fuel hose;

wherein the fuel supply is located on a fuel shuttle.

* * * * *